US007963199B2

(12) United States Patent
Mayfield et al.

(10) Patent No.: US 7,963,199 B2
(45) Date of Patent: Jun. 21, 2011

(54) VERTICAL SPINNER

(75) Inventors: David Mayfield, South Bend, IN (US); Joseph Harry Krenz, Warsaw, IN (US); Krishnathejan Akumalla, Mishawaka, IN (US)

(73) Assignee: Hess Industries, Inc., Niles, MI (US)

( * ) Notice: Subject to any disclaimer, the term of this patent is extended or adjusted under 35 U.S.C. 154(b) by 1069 days.

(21) Appl. No.: 11/677,752

(22) Filed: Feb. 22, 2007

(65) Prior Publication Data

US 2008/0041201 A1 Feb. 21, 2008

Related U.S. Application Data

(60) Provisional application No. 60/775,654, filed on Feb. 22, 2006.

(51) Int. Cl.
*B23B 3/20* (2006.01)
*B23B 3/00* (2006.01)

(52) U.S. Cl. ..... 82/122; 82/117

(58) Field of Classification Search ..... 82/122, 82/117, 142, 150, 165; 29/38 A, 38 B
See application file for complete search history.

(56) References Cited

U.S. PATENT DOCUMENTS

| | | | | |
|---|---|---|---|---|
| 2,567,334 | A * | 9/1951 | Harrison et al. | 72/14.6 |
| 3,153,437 | A * | 10/1964 | Donato | 72/80 |
| 3,190,097 | A * | 6/1965 | Horn et al. | 72/210 |
| 3,253,444 | A * | 5/1966 | Dolan et al. | 72/107 |
| 4,546,681 | A * | 10/1985 | Owsen | 82/162 |
| 4,738,170 | A * | 4/1988 | Isawa et al. | 82/122 |
| 4,953,376 | A | 9/1990 | Merlone | |
| 6,352,496 | B1 * | 3/2002 | Oldani | 483/55 |
| 7,013,544 | B2 * | 3/2006 | Yasuda et al. | 29/27 C |
| 7,506,423 | B2 * | 3/2009 | Iwabuchi et al. | 29/27 C |
| 2008/0041201 | A1 * | 2/2008 | Mayfield et al. | 82/64 |

FOREIGN PATENT DOCUMENTS

| | | |
|---|---|---|
| DE | 3804656 | 8/1989 |
| EP | 1025923 | 9/2000 |
| FR | 2843901 | 5/2004 |
| GB | 2184676 | 7/1987 |

OTHER PUBLICATIONS

International Search Report for PCT/US2007/062561 issued by the European Patent Office on Jul. 4, 2007.

* cited by examiner

*Primary Examiner* — Will Fridie, Jr.
(74) *Attorney, Agent, or Firm* — Baker & Daniels LLP

(57) ABSTRACT

The present invention relates to a spinning apparatus for forming a workpiece when the workpiece is arranged in a substantially vertical orientation. The spinning apparatus includes at least one tool capable of altering the shape of the workpiece while spinning. The apparatus also includes a clamp configured to hold the workpiece as the tool works the workpiece. The spinning apparatus includes a spinning arrangement allowing for the vertical arrangement of the workpiece while the tool is working on the workpiece.

33 Claims, 40 Drawing Sheets

VERTICAL SPINNER

This application claims the benefit of U.S. Provisional Patent Application Ser. No. 60/775,654 filed Feb. 22, 2006, the complete disclosure of which is hereby expressly incorporated by reference.

BACKGROUND OF THE INVENTION

The present invention relates to a spinning system. Specifically, the present invention relates to a spinning system having an arrangement allowing for the spinning of a workpiece in a substantially vertical orientation.

DESCRIPTION OF THE PRIOR ART

U.S. Pat. No. 288,953 discloses a Machine for Turning and Boring. The disclosed invention comprises a casing for covering and protecting a feed-gearing arrangement including a series of feed-gears. The casing is adapted to be vibrated about the axis of the driving-shaft of the boring and turning machine. The casing is configured to be connected and disconnected from the machine, as necessary. A socket or bearing may be used, in conjunction with the casing, in order to protect feed gears. In addition, a clamping screw may also be utilized to affix the casing to the machine in order to protect the feed-gears.

U.S. Pat. No. 3,099,929 discloses a Bar Scalping Machine for the scalping or skimming of metal bars or other elongated workpieces. The machine provides for a revolving cutter head through which material is progressively fed, while the material is maintained in a non-rotary position. The cutting tools are mounted on the cutter head and may be adjustable during rotation of the head. The machine further utilizes a substantially stationary, non-rotatable guide element to serve as a diameter gauging device. The guide element may also be used to control the cutting tools.

U.S. Pat. No. 6,536,315, the disclosure of which is expressly incorporated herein by reference, sets forth a Spinning Device. The spinning device performs a spinning operation by driving a working tool in revolution on a member to be machined. The member is held in a non-rotary fashion. The machine further performs functions such as cutting, etc., after the spinning. The disclosed spinning system comprises a first rotor provided at the tip of an outer tube and a second rotor provided at the tip of an inner tube. The second rotor includes a first guide route and a second guide route. The first rotor movably supports a first working tool and a second working tool. The working tools moveably travel along the first and second guide routes present within the second rotor in order to form the non-rotary member that is to be machined.

SUMMARY OF THE INVENTION

The present invention relates to a vertical spinner comprising a clamp capable of supporting a workpiece, a spinning arrangement capable of acting on at least a portion of the workpiece in order to form an end of the workpiece and a frame providing sufficient support to the clamp and the spinning arrangement. In the present invention, one of the clamp and the spinning arrangement are positioned vertically above the other of the clamp and spinning arrangement.

In an embodiment of the present invention, the clamp includes a plurality of clamping members. Each clamping member includes a forward face directed toward a receiving area of the clamp. The receiving area is configured to receive the workpiece. In an embodiment of the present invention, each of the clamping members is moveable independent of the other clamping members. In an embodiment of the invention, the clamp includes four clamping members.

In an embodiment of the invention, the spinning arrangement includes a harmonic drive and a spinner head. The spinner head includes a housing, a hub and at least one roller assembly. In embodiments of the invention, the roller assemblies include a link arm, a connector arm, a pivot and a roller. The link arm pivots about the pivot. The roller is connected to the link arm at one end, and the connector is connected to the link arm at the opposing end. In addition, the opposite end of the connector opposite the link arm connected to the hub. In an embodiment of the invention, the spinning arrangement may also include two roller assemblies. In addition, in an embodiment of the invention, the spinning arrangement may further include a cutting tool.

BRIEF DESCRIPTION OF THE DRAWINGS

The above-mentioned and other features and advantages of this invention, and the manner of attaining them, will become more apparent and the invention itself will be better understood by reference to the following description of various embodiments of the invention taken in conjunction with the accompanying drawings, wherein.

Corresponding reference characters indicate corresponding parts throughout the several views. The exemplifications set out herein illustrate embodiments of the invention, in various forms, and such exemplifications are not to be construed as limiting the scope of the invention in any manner.

DETAILED DESCRIPTION OF AN EMBODIMENT OF THE INVENTION

Figure 1:
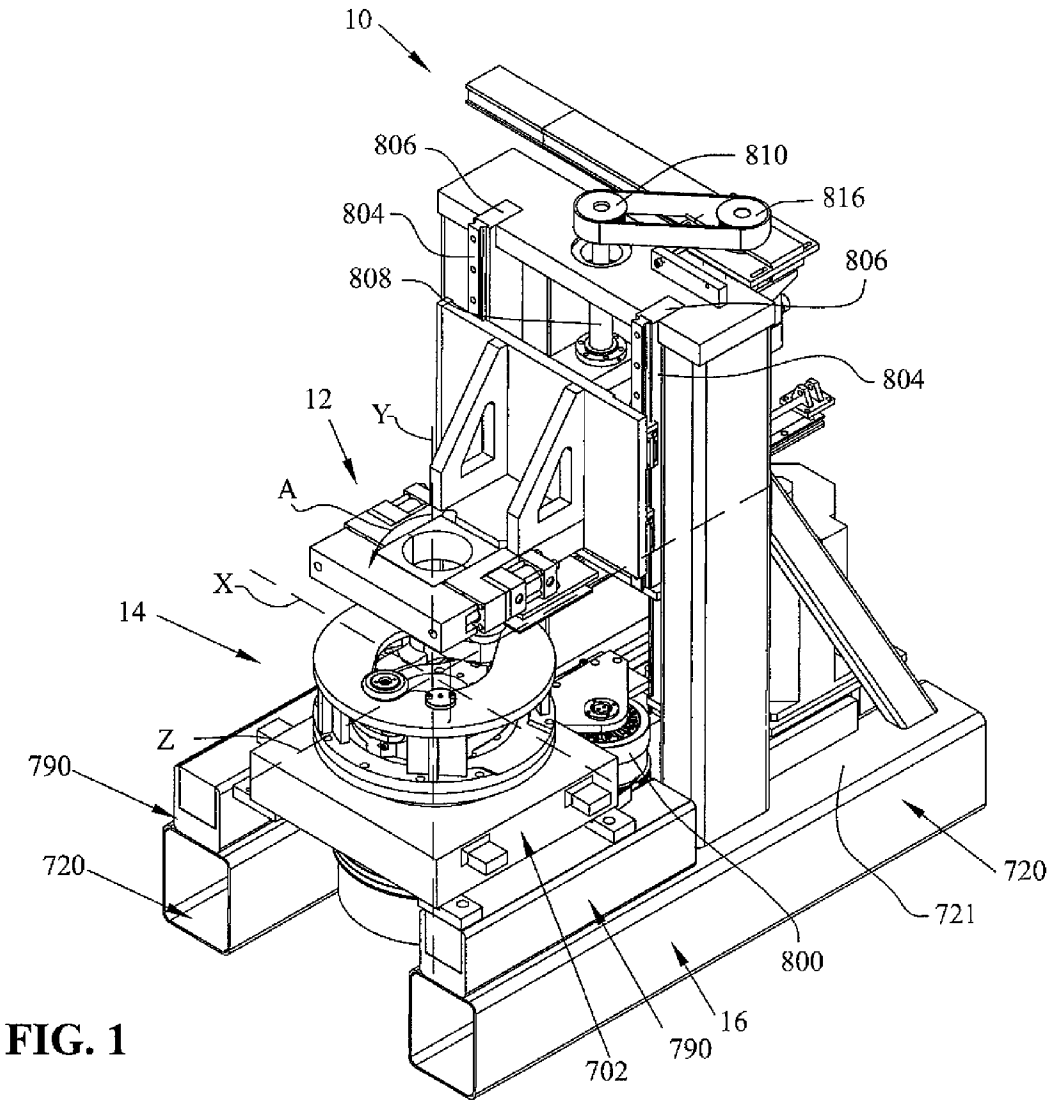
FIG. 1 depicts a perspective view of an embodiment of the present invention.
Figure 2:
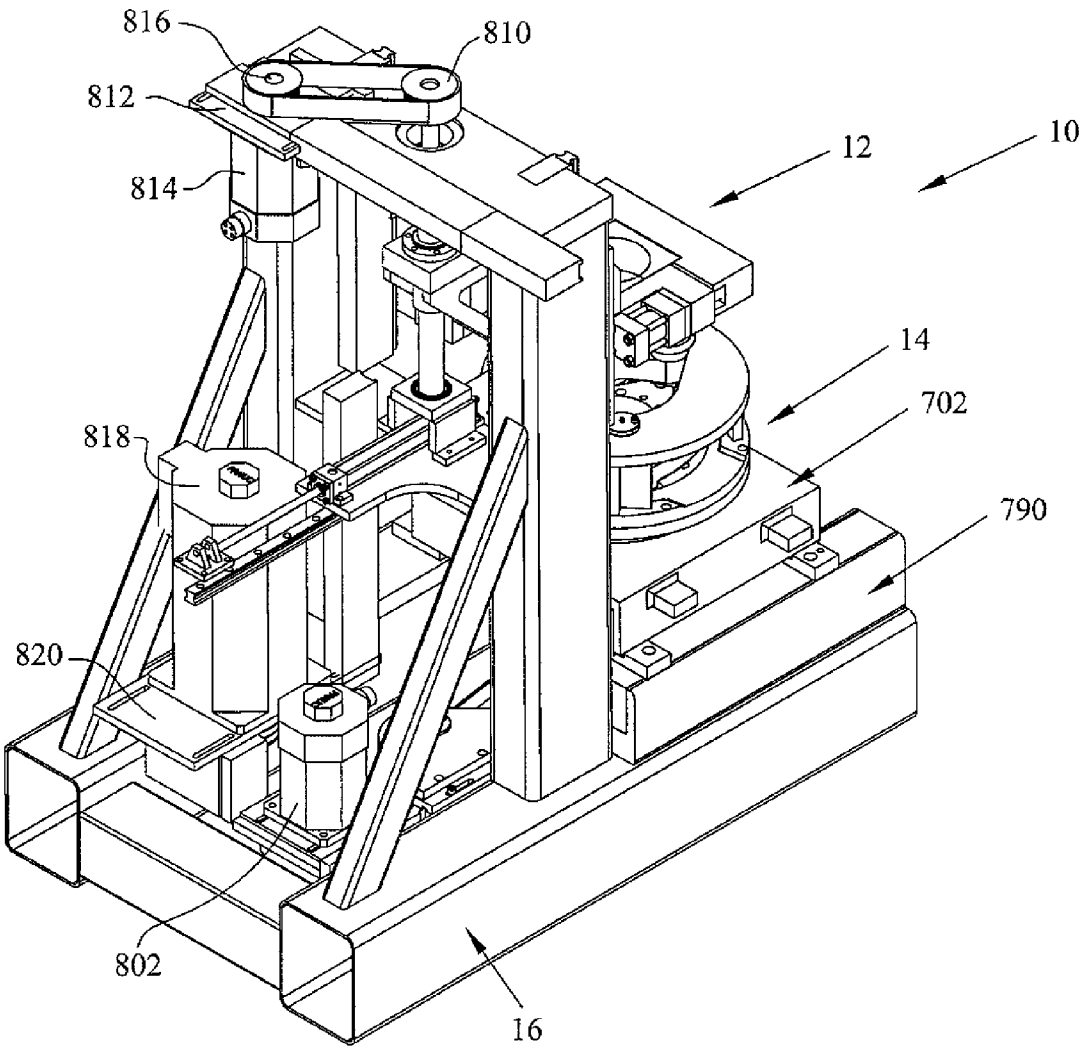
FIG. 2 depicts a rear perspective view of the embodiment of the invention depicted in FIG. 1.

Referring first to FIGS. 1 and 2, numeral 10 generally indicates a vertical spinner. In the present embodiment, vertical spinner 10 includes a clamp 12, a spinning arrangement 14 and a frame 16.

Figure 3:
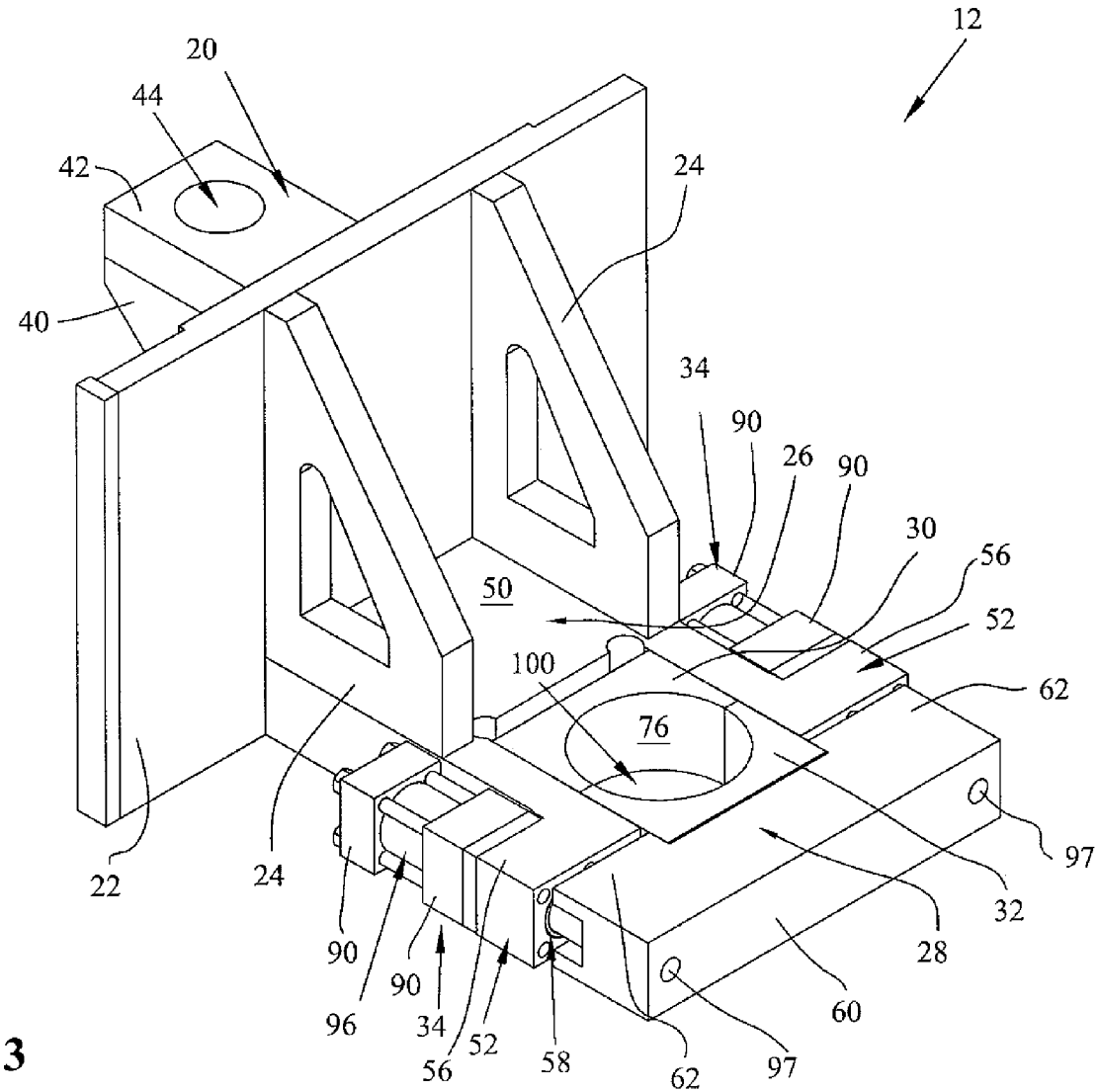
FIG. 3 depicts a perspective view of a clamp utilized in embodiments of the invention.
Figure 4:
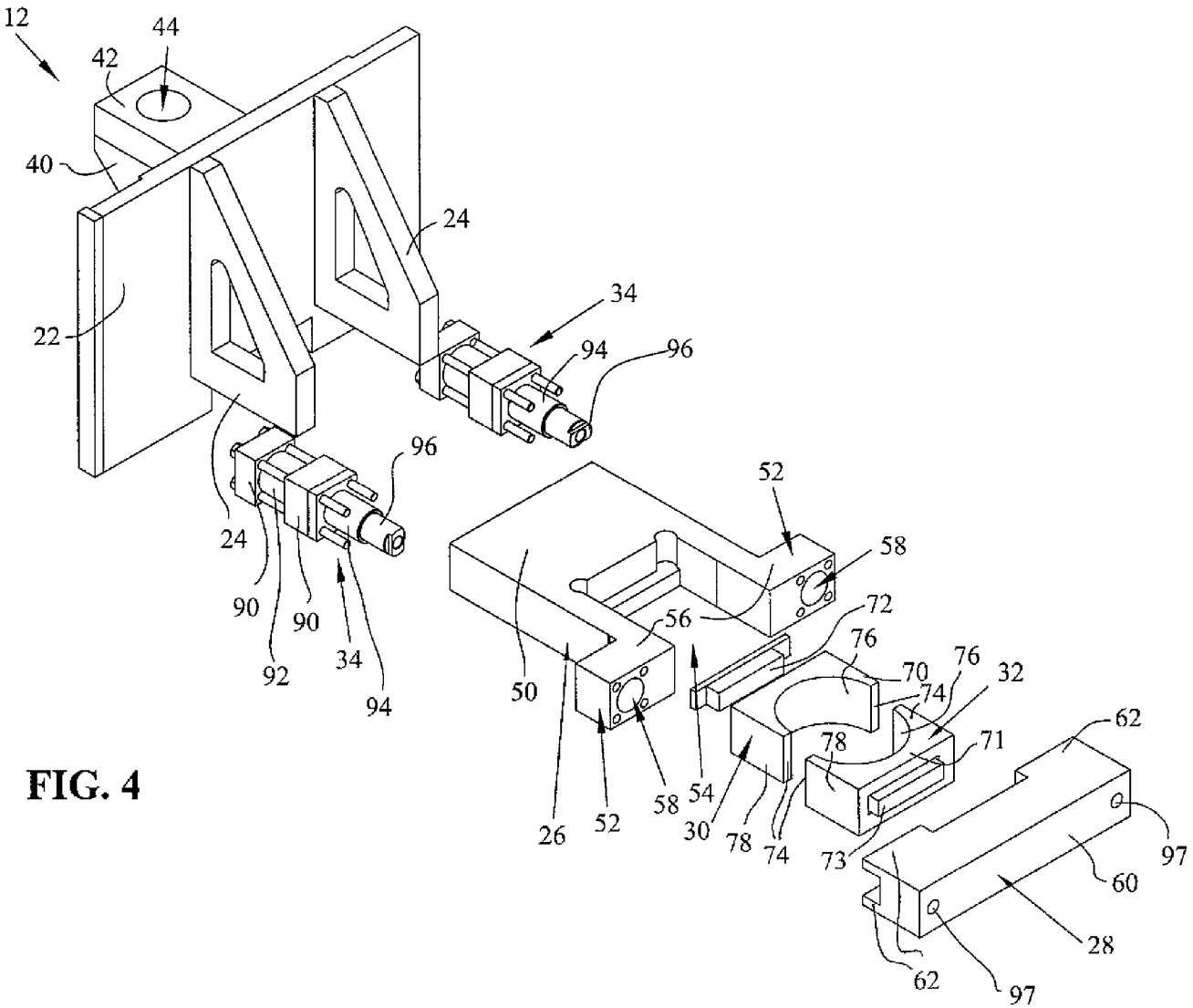
FIG. 4 depicts an exploded perspective view of the clamp depicted in FIG. 3.
Figure 5:
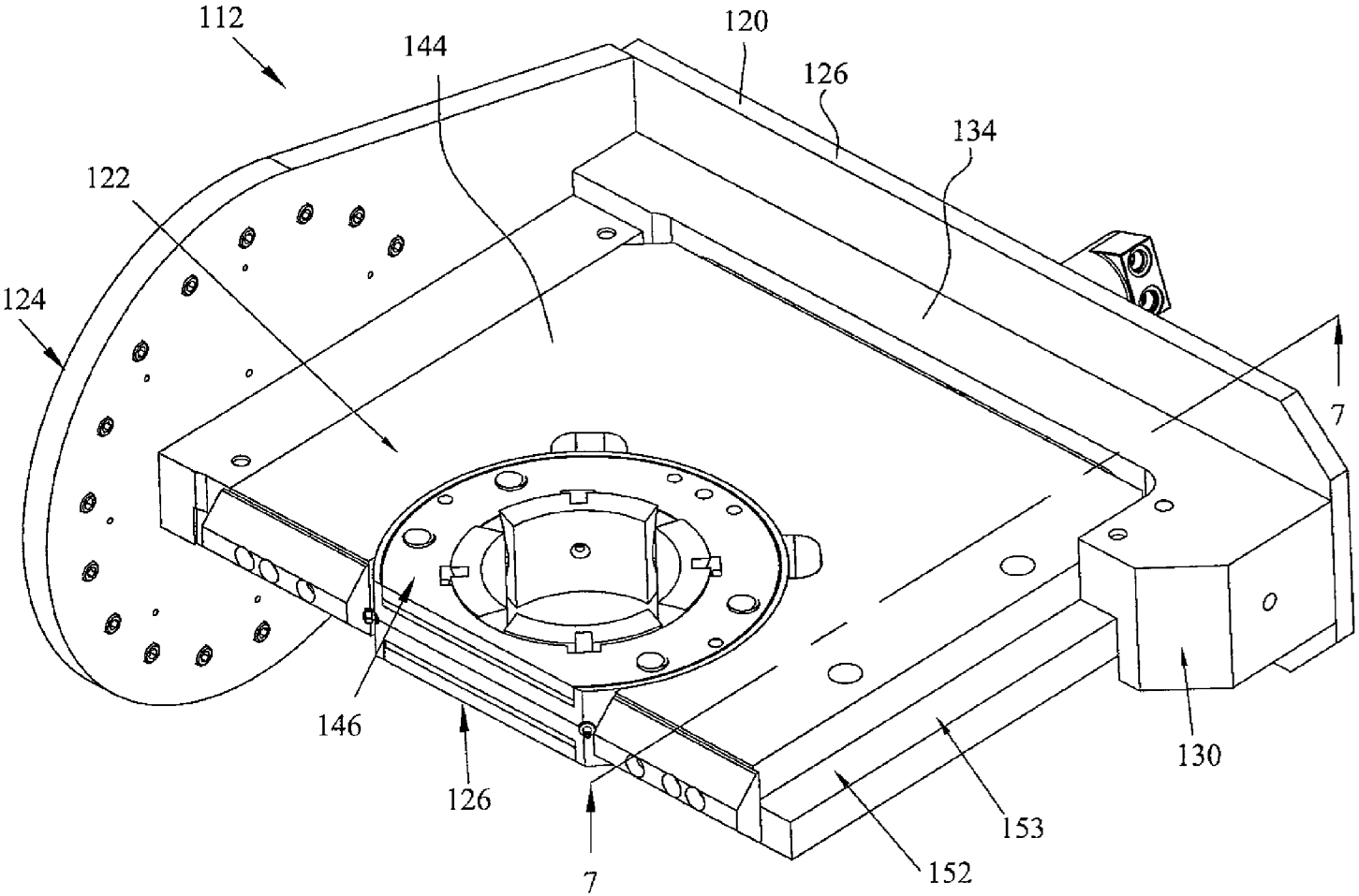
FIG. 5 depicts a perspective view of an alternative embodiment of a clamp used in the present invention.
Figure 6:
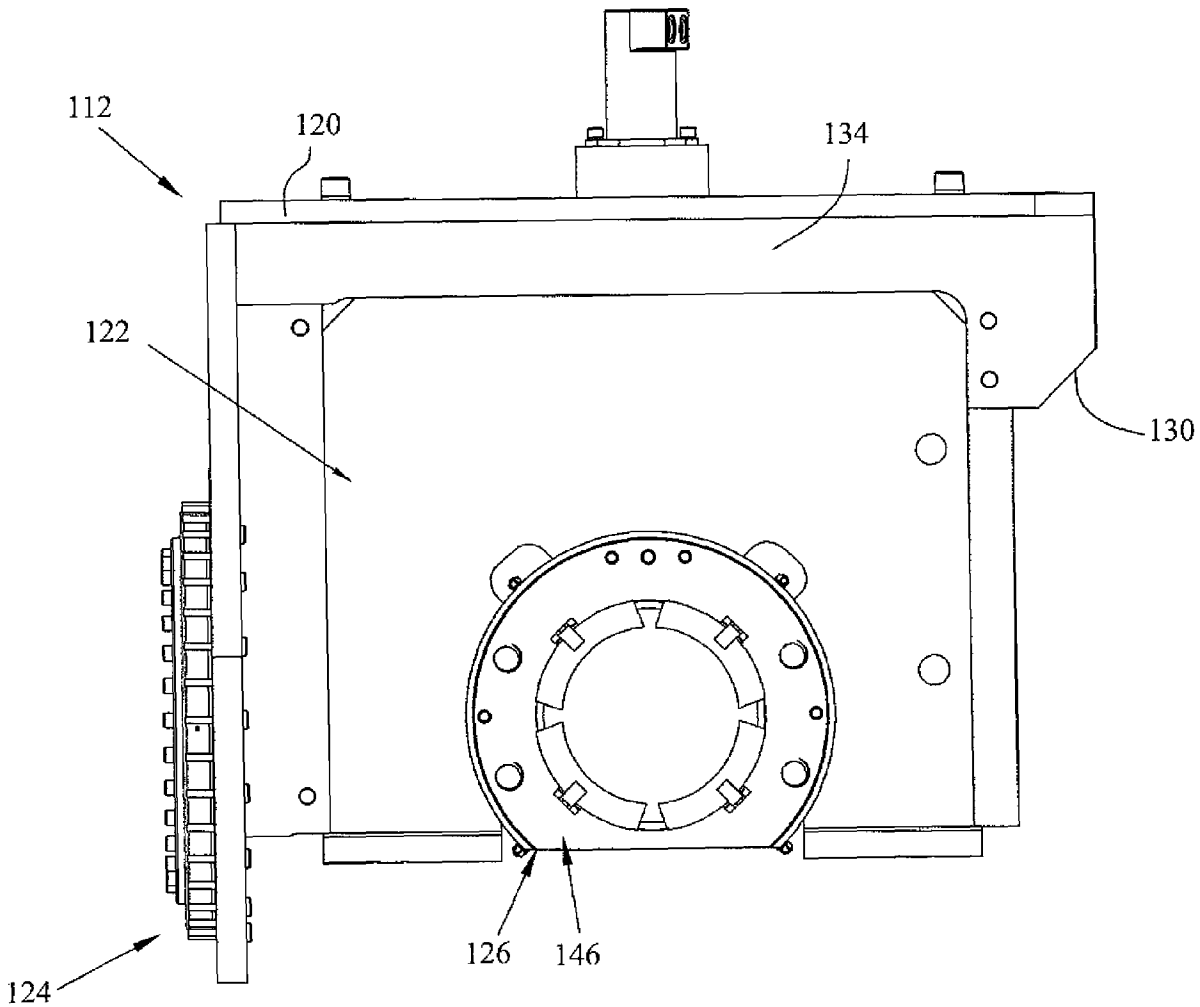
FIG. 6 depicts a top view of the clamp depicted in FIG. 5.

Referring now to FIGS. 3 and 4, clamp 12 will be described. In the present embodiment, clamp 12 includes an attachment portion 20, a vertical plate 22, a pair of angle plates, each indicated by numeral 24, a base plate 26, a front plate 28, a first clamping member 30, a second clamping member 32 and a pair of drive assemblies, each generally indicated by numeral 34.

The attachment portion 20 may be affixed to vertical plate 22 in any suitable manner, such as by welding, for example. In embodiments of the invention, a plurality of fasteners (not shown) may also be utilized to attach the attachment portion 20 to the vertical plate 22. In the depicted embodiment, the attachment portion 20 includes a pair of angle irons 40 and a flat plate 42. Flat plate 42 includes an aperture 44.

In the embodiment depicted, the angle plates 24 connect vertical plate 22 to base plate 26. Angle plates 24 may be affixed to vertical plate 22 and the base plate 26 in any suitable manner. For example, the angle plates 24 may be welded to both the vertical plate 22 and the base plate 26. In other embodiments, a plurality of fasteners (not shown) may also be utilized to attach the angle plates 24 to both the vertical plate 22 and the base plate 26.

Referring still to FIGS. 3 and 4, base plate 26 includes a main body 50 and a pair of arms, each generally indicated by numeral 52. The arms 52 extend away from body 50 and define an intermediate receiving area, generally indicated by numeral 54. Each of the arms 52 includes an extension 56 through which an aperture 58 extends.

Front plate 28 includes a main body 60 and a plurality of arm portions, each generally indicated by numeral 62. In the depicted embodiment, arms 62 extend away from main body 60 in the direction of base plate 26.

Referring still to FIGS. 3 and 4, in the depicted embodiment, first clamping member 30 includes a semi-circular member 70 and a mating member 72. Member 70 includes a pair of arms, each indicated by numeral 74, an arcuate surface 76 and side surfaces 78. The area intermediate arcuate surface 76 and one of the side surfaces 78 may generally define an arm 74. In the depicted embodiment, the side surfaces 78 are generally located opposite arcuate surface 76.

Semi-circular member 70 may be attached to mating member 72 in any suitable manner, such as via fasteners (not shown) or welding, for example. In embodiments of the invention, semi-circular member 70 and mating member 72 may be formed as a single component from any suitable material.

Referring still to FIGS. 3 and 4, second clamping member 32 has a structure similar to that of first clamping member 30. In the depicted embodiment, second member 32 includes a semi-circular member 71 and a mating member 73. In a manner similar to semi-circular member 70, semi-circular member 71 includes a pair of arms, each indicated by numeral 74, an arcuate surface 76 and side surfaces 78. The area intermediate arcuate surface 76 and one of the side surfaces 78 may generally define an arm 74. In the depicted embodiment, the side surfaces 78 are generally located opposite arcuate surface 76.

Semi-circular member 71 may be attached to mating member 73 in any suitable manner, such as via fasteners (not shown) or welding, for example. In embodiments of the invention, semi-circular member 71 and mating member 73 may be formed as a single component from any suitable material.

Referring still to FIGS. 3 and 4, first clamping member 30 may mate with base plate 26 in any suitable manner. For example, receiving area 54 of base plate 26 may receive first clamping member 30. Once receiving area 54 has received first clamping member 30, mating member 72 of first clamping member 30 may be affixed to a portion of base plate 26 in any suitable fashion such as via fasteners (not shown) or welding, for example. Once member 30 is affixed to base plate 26, the side surfaces 78 of arms 74 should reside against the inner portion of arms 52.

Similarly, second clamping member 32 may mate with front plate 28 in any suitable manner. For example, second clamping member 32 may by located intermediate arm portions 62. Mating member 73 may then be affixed to body portion 60 in a suitable manner, such as by welding or with fasteners, for example. When second clamping member 32 is affixed to front plate 28, a portion of side surfaces 78 should contact the inner surface of the arms 62.

With reference still to FIGS. 3 and 4, in the depicted embodiment, each drive assembly 34 includes a plurality of attachment members, each indicated by numeral 90, and a motor, generally indicated by numeral 92. Attachment members 90 are affixed to the outer portions of arms 52 in any suitable manner. In addition, attachment portions 90 are configured to receive and retain in a relatively fixed position a portion of motor 92. In the depicted embodiment, motor 92 includes a body 94 and extension 96, and motor 92 is configured to allow extension 96 to be withdrawn into, and extend away from, body 94, as desired.

In the depicted embodiment, body 94 of motor 92 resides within the attachment members 90, in any suitable manner, and extension 96 extends into, and is affixed to, the arms 62 of front plate 28 in any suitable manner. For example, arms 62 may include an aperture 97 configured to receive a member (not shown) that couples with extensions 96.

The extensions 96 of motors 92 may move into, or extend away from, the bodies 94 upon receiving a predetermined signal, such as electric current, for example. The movement of the extensions 96 causes front plate 28 to move away from and separate from base plate 26. As second clamping member 32 is attached to front plate 28 and first clamping member 30 is attached to base plate 26, the clamping members 30, 32 will also separate as the plates 26, 28 separate. The separation of the members 30, 32 increases the size of a receiving area, generally indicated by numeral 100. When the motors 92 receive a second predetermined signal, causing the extensions 96 to be withdrawn into the bodies 94, the members 30, 32 will be drawn together and decrease the size of the receiving areas 100.

Thus, when one desires clamp 12 to clamp a component (not shown), one may separate the clamping members 30, 32 in a manner similar to that described above. One may then locate the component into receiving area 100 and activate the motors 92 so that the extensions 96 are withdrawn into the bodies 94. The movement of the extensions 96 into the bodies 94 moves the front plate 28 and second clamping member 32 in the direction of the base plate 26 and the first clamping member 30. The movement of second member 32 toward first member 30 decreases the size of the receiving area 100 and allows the clamping members 30, 32 to engage the component and retain the component in the receiving area.

Referring now to FIGS. 5 through 14, an alternative embodiment of a clamp, generally indicated by numeral 112, is illustrated. In the depicted embodiment, clamp 112 includes a base 120, a main portion 122 and pivot control mechanism 124.

Figure 8:
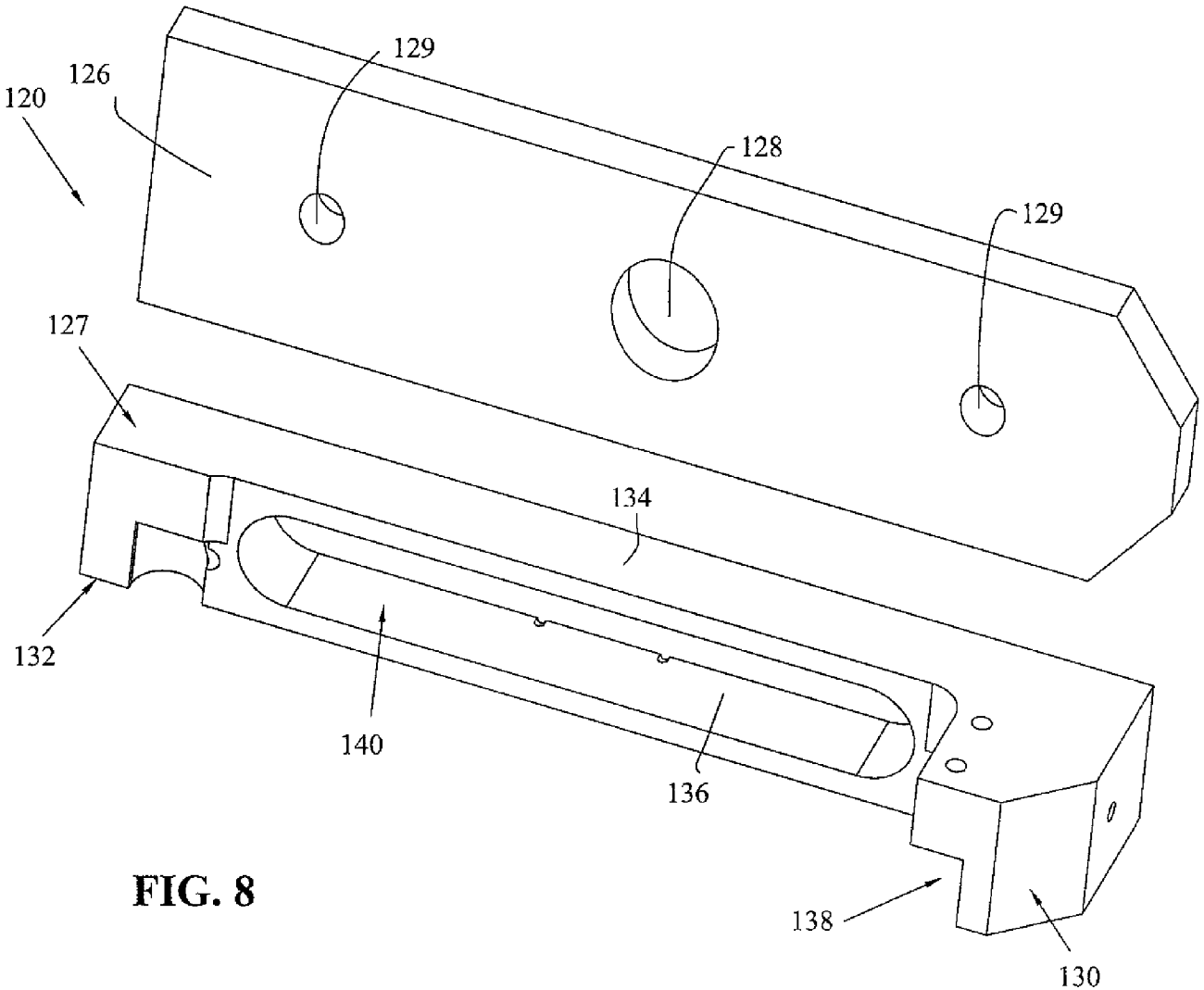
FIG. 8 depicts an exploded perspective view of a base portion utilized in the embodiment of a clamp depicted in FIG. 5.

As shown in FIG. 8, in the depicted embodiment, the base portion 120 includes a plate 126 and a member 127. Plate 126 may be formed from any suitable material, and in the depicted embodiment, plate 126 includes a central aperture 128 and a pair of offset apertures 129. The apertures 129 are arranged in a flanking arrangement with respect to central aperture 128.

In the depicted embodiment, member 127 includes a first end 130, a second end 132, an upper plate 134 and a lower plate 136. Member 127 may be formed from any suitable material, and first end 130 and second end 132 may have any suitable configuration. In the depicted embodiment, first end 130 includes a notch, generally indicated by numeral 138, and the ends 130, 132 are located at opposite ends of the plates 134, 136. In the depicted embodiment, the plates 134, 136 are arranged in a substantially parallel manner and extend intermediate to the ends 130, 132. The ends 130, 132 and plates 134, 136 may be affixed together in any suitable manner, and the ends 130, 132 and plates 134, 136 define an opening, generally indicated by numeral 140.

Referring again to FIGS. 5 through 7, main portion 122 includes a housing 144 and a clamping arrangement, generally indicated by numeral 146. In the depicted embodiment, housing may be formed from any suitable material. Housing 144 has a substantially rectangular configuration defined by a first end 148, a second end 150 and sides 152. In the depicted embodiment, the sides 152 may include stepped portions 153. At least one of the stepped portions may be sized so as to be received by notch 138 of the base 120.

Figure 7:
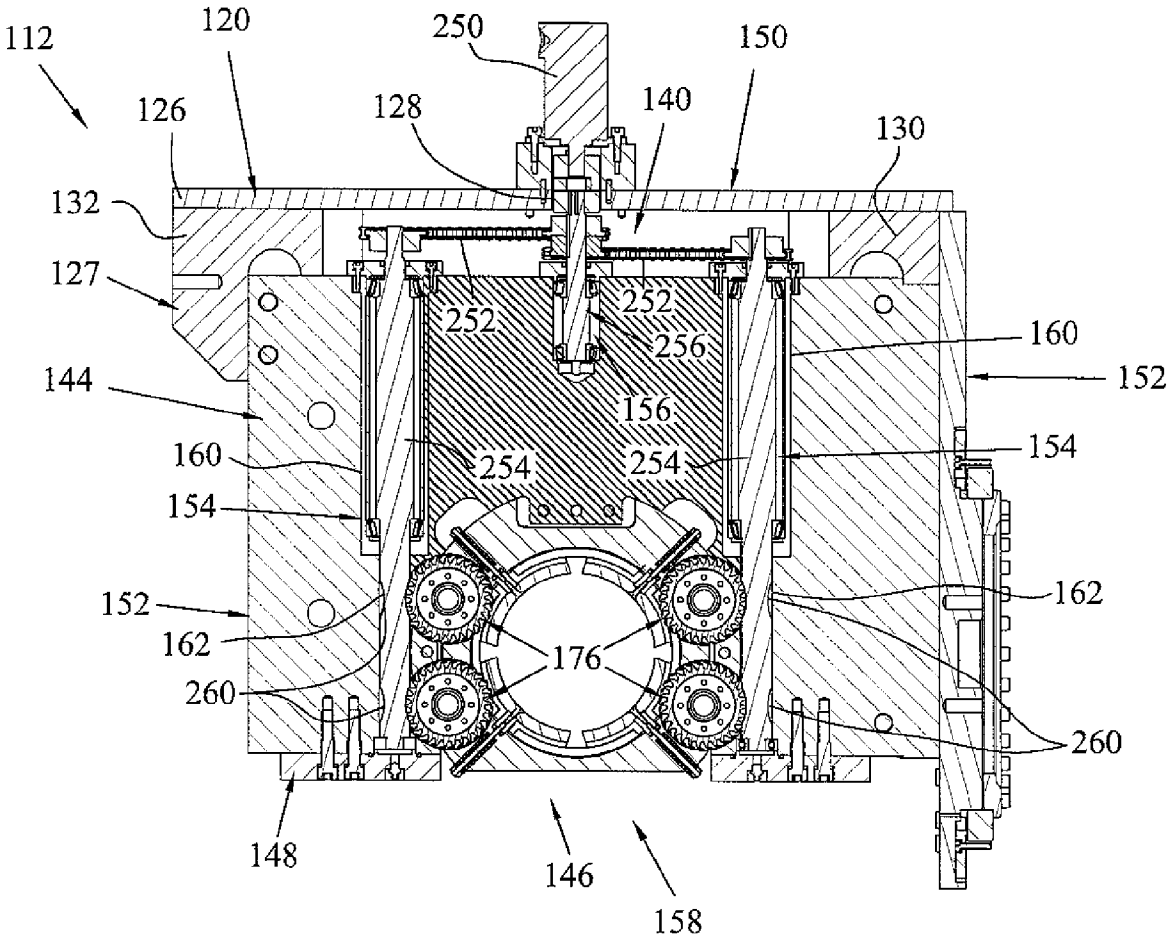
FIG. 7 depicts a section view of the clamp depicted in FIG. 5 taken along section line 7-7.

With reference now to FIG. 7, in the depicted embodiment, housing 144 includes a pair of through passages, each indicated by numeral 154, a truncated passage 156 and an open area 158. Through passages 154 extend from first end 148 to second end 150 and each includes a larger diameter portion 160 and a smaller diameter portion 162. In the depicted embodiment, larger diameter portion 160 is located proximate second end 150, and small diameter portion 162 is located proximate first end 152.

Referring still to FIG. 7, truncated passage 156 extends from first end 148 in the direction of second end 150. Truncated passage 156 has a substantially circular cross section and is located at substantially the center of first end 148.

Open area 158 is located at substantially the center of first end 148. Open area 158 extends in the direction of second end 150 and ends at approximately the midpoint between first end 148 and second end 150.

With reference now to FIGS. 5 through 14, in the depicted embodiment, clamping arrangement 146 includes an upper plate 170, a lower plate 172, a plurality of worm gears, each indicated by numeral 174, a plurality of clamp assemblies, each indicated by numeral 176, and a housing 178.

Figure 9:
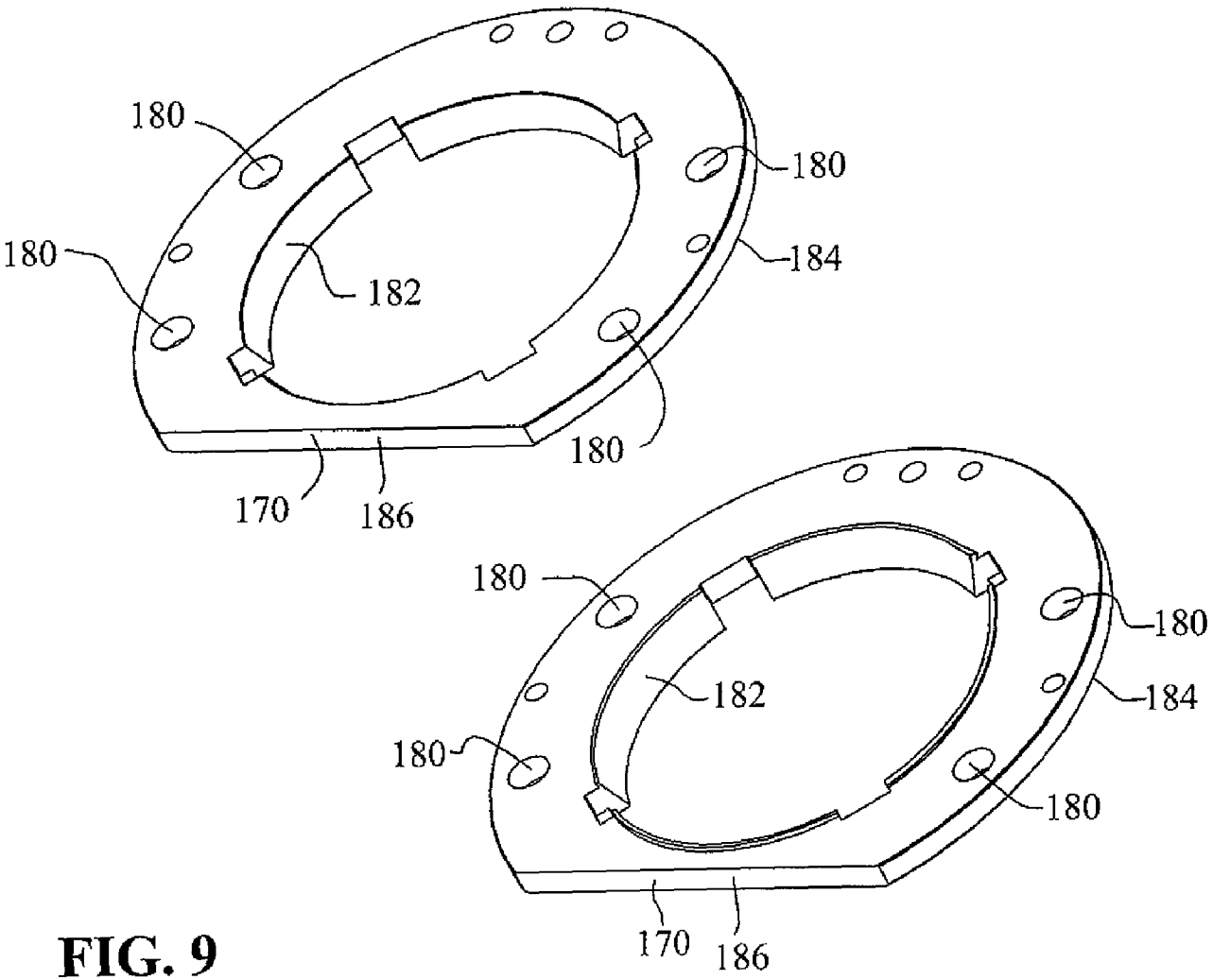
FIG. 9 depicts an exploded perspective view of a component utilized in the embodiment of the clamp depicted in FIG. 5.

With reference now specifically to FIG. 9, in the depicted embodiment, upper plate 170 and lower plate 172 have substantially identical configurations, but are arranged as mirror images. Each of the plates 170, 172 include a plurality of threaded apertures, each generally indicated by numeral 180. In addition, each of the plates 170, 172 includes an inside edge portion 182. In the depicted embodiment, the plates 170, 172 have a substantially circular shape comprising an arcuate portion 184 and straight portion 186, and the plates 170, 172 may be formed from any suitable material.

Figure 10A:
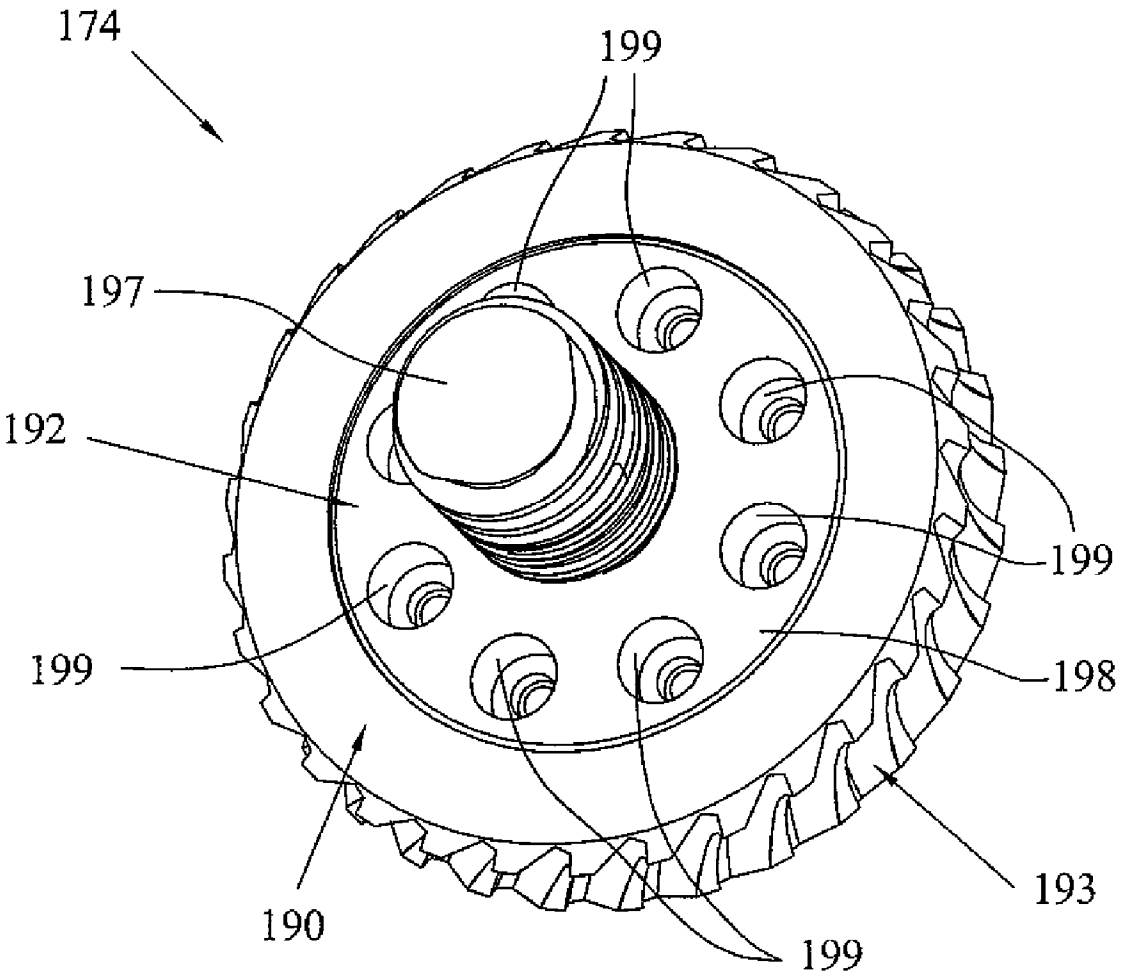
FIG. 10A depicts a perspective view of a component utilized in the embodiment of the clamp depicted in FIG. 5.
Figure 10B:
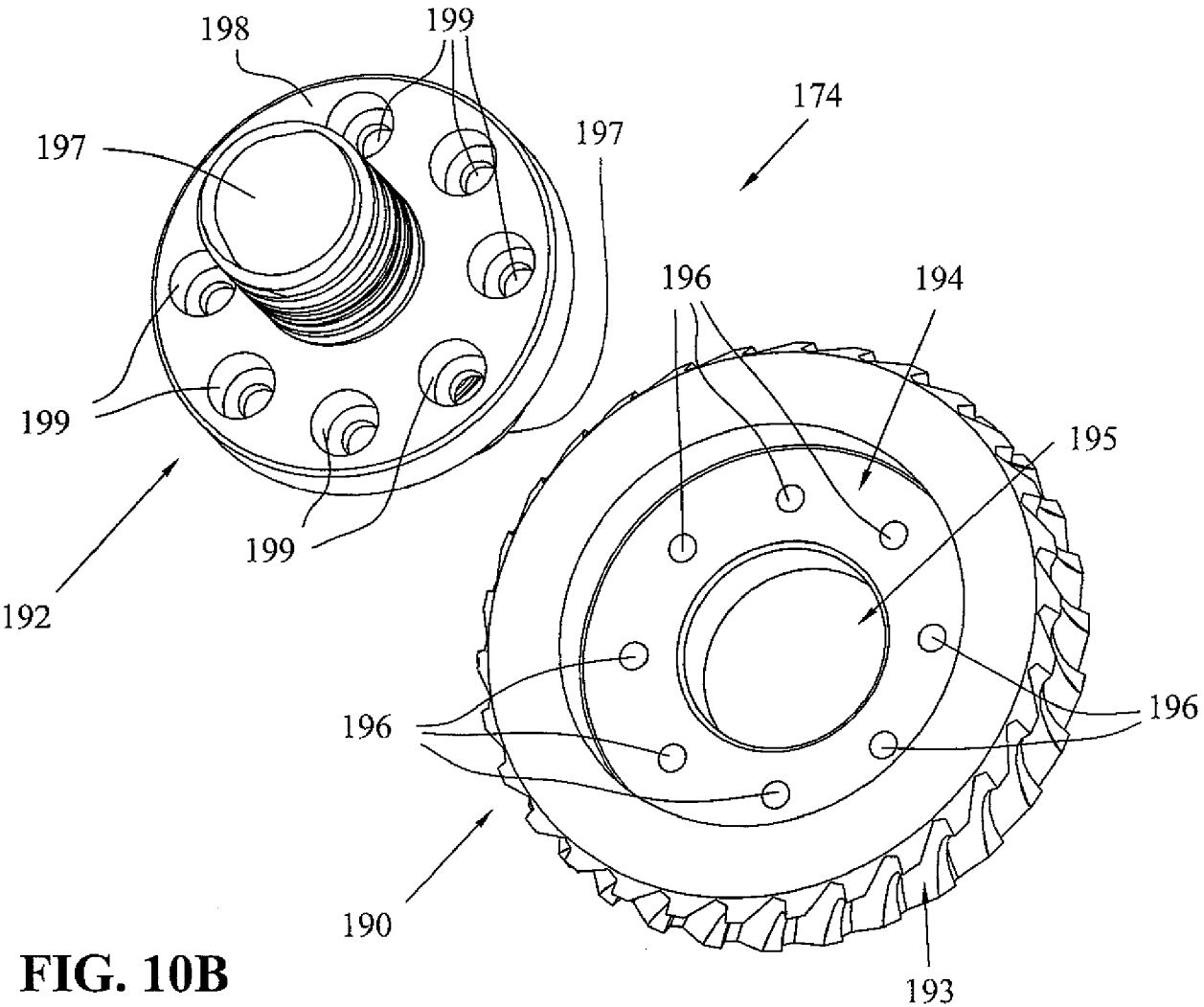
FIG. 10B depicts an exploded perspective view of the component depicted in FIG. 10A.
Figure 11:
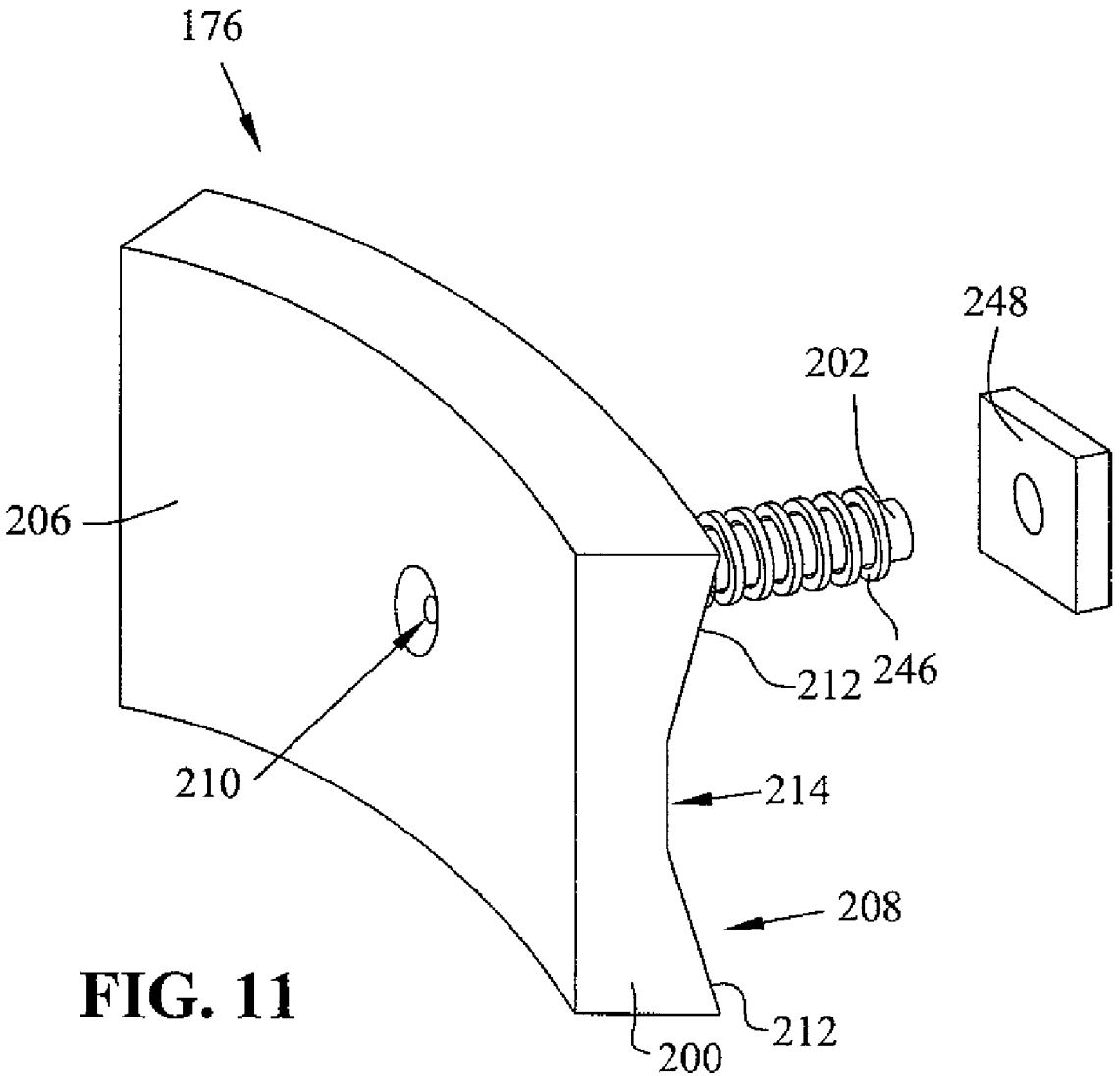
FIG. 11 depicts a perspective view of a component utilized in the embodiment of the clamp depicted in FIG. 5.

As shown in FIGS. 10A and 10B, worm gears 174 include a gear portion 190 and a threaded member combination 192. Gear portion 190 may be of any gear type know in the art having a plurality of teeth 193, a recessed area 194, a central aperture 195, and a plurality of apertures, each indicated by numeral 196. The threaded member combination 192 includes a pair of threaded members 197 and a flat plate 198. In the depicted embodiment, the threaded members 197 extend in opposite directions from flat plate 198. Flat plate 198 includes a plurality of apertures each indicated by numeral 199.

Threaded member combination 192 may be coupled to gear portion 190 by locating flat plate 198 within recessed area 194. When flat plate 198 is located within recessed area 194, one of the threaded members 197 will extend through central aperture 195. In addition, the surrounding apertures 196 of gear portion 190 should align with apertures 199 of flat plate 198. A fastener (not shown) may then be inserted into the apertures 195, 199 in order to affix the threaded member combination 192 to the gear portion 190.

With reference to FIG. 1, each clamp assembly 176 includes a clamping member 200 and a rod 202. Clamping member 200 includes a front face 206, a rear portion 208 and an aperture 210 extending from front face 206 to rear portion 208. In the depicted embodiment, front face 206 may be arcuately shaped and substantially smooth.

Rear portion 208 includes two ramp portions 212 and a groove 214. In the depicted embodiment, the ramp portions 212 are arranged in order to ensure the portions 212 are nearest front face 206 at groove 214 and move away from face 206 as the portions move away from groove 214. Each of the ramp portions 212 are substantially smooth, as is groove 214.

In the present embodiment of the invention, rod 202 extends at least partially through aperture 210 and may be attached to clamping member 200 in any suitable manner. For example, rod 202 may include a head portion (not shown) of sufficient size to prevent travel of the head portion through aperture 210, while the remainder of the rod 202 extends through aperture 210.

Figure 12:
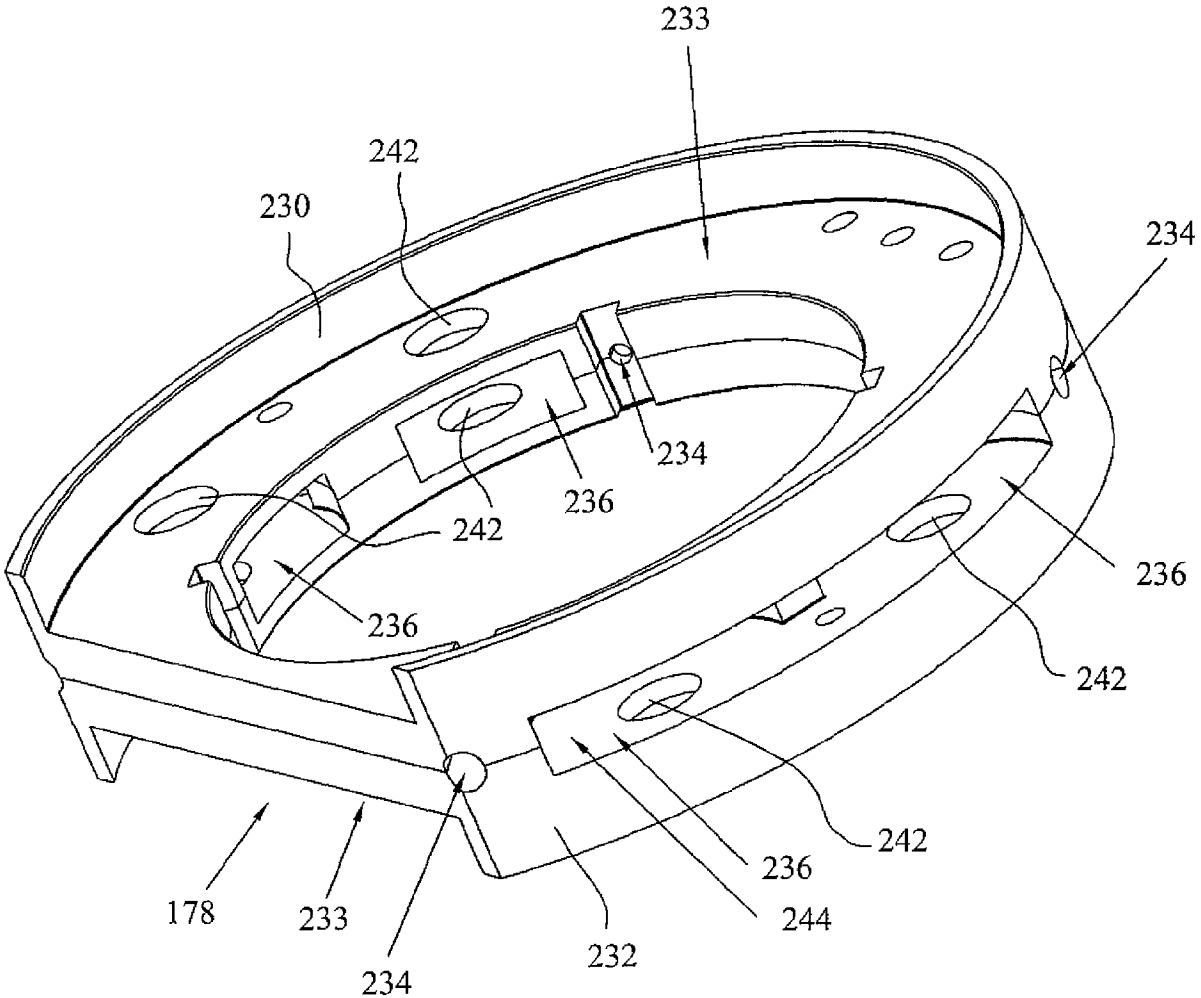
FIG. 12 depicts a perspective view of a component utilized in the embodiment of the clamp depicted in FIG. 5.
Figure 13:
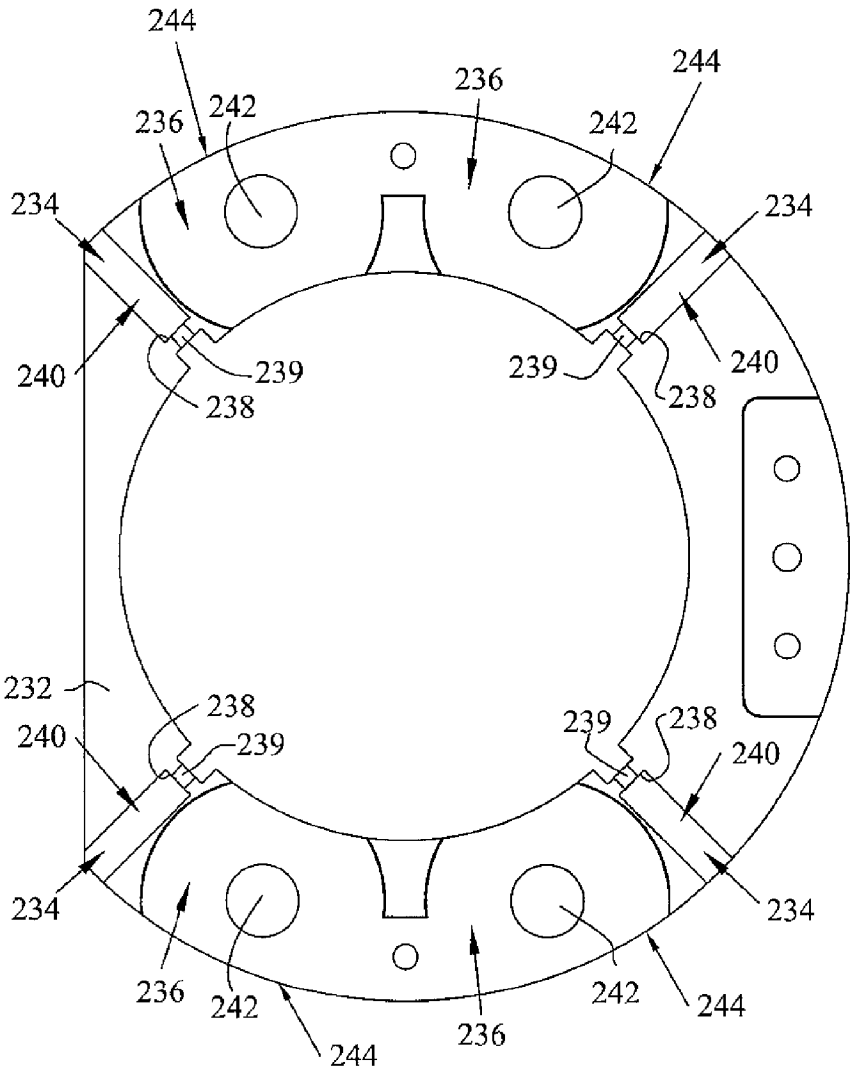
FIG. 13 depicts a top view of one member comprising the component depicted in FIG. 12.

As shown in FIGS. 12 and 13, housing 178 includes an upper main body 230 and a lower main body 232. Each of the main bodies 230, 232 has substantially identical configurations but represent mirror images of each other. The main bodies 230, 232 each include a recessed area, generally indicated by numeral 233, a plurality of channels 234 and a plurality of receiving areas 236. Each of the channels 234 is sized and configured to receive a rod 202 of clamp assembly 176, and each of the channels 234 includes a land 238 delineating a smaller diameter portion 239 and a larger diameter portion 240 of the channel 234.

The receiving areas 236 of the main bodies 230, 232 are sized and configured to receive gear portion 190 of the worm gears 174. Each receiving area 236 includes an aperture 242 sized and configured to receive one of the threaded members 192 of one of the worm gears 174. Apertures 242 are substantially smooth, thereby allowing the threaded members 192 to rotate freely when positioned therein. Each receiving area 236 includes two openings 244 through which portions of gear portion 190 may extend while the remainder of gear portion 190 remains located within receiving area 236.

With reference again to FIGS. 7 and 14, clamp mechanism 126 includes a motor 250, a pair of chains, each indicated by numeral 252, and a pair of worms, each indicated by numeral 254. In the present embodiment, motor 250 may be any suitable motor known in the art, such as a hydraulic motor or an electric motor, for example. In the depicted embodiment, motor 250 includes a spindle 256 configured to mate with the chains 252.

Each of the worms 254 includes a chain mating area 258 and threads 260. The chain mating areas 258 are configured to mate with the chains 252 in a suitable manner. It should be understood that the chains 252 translate rotation of spindle 256 to the worms 254.

The threads 260 of the worms 254 are configured to mate with the gear portion 190 of the worm gears 174, in a suitable manner. Thus, the rotation of the spindle 256 of motor 250 should ultimately cause rotation of thread members 192 of the worm gears 174.

Figure 14:
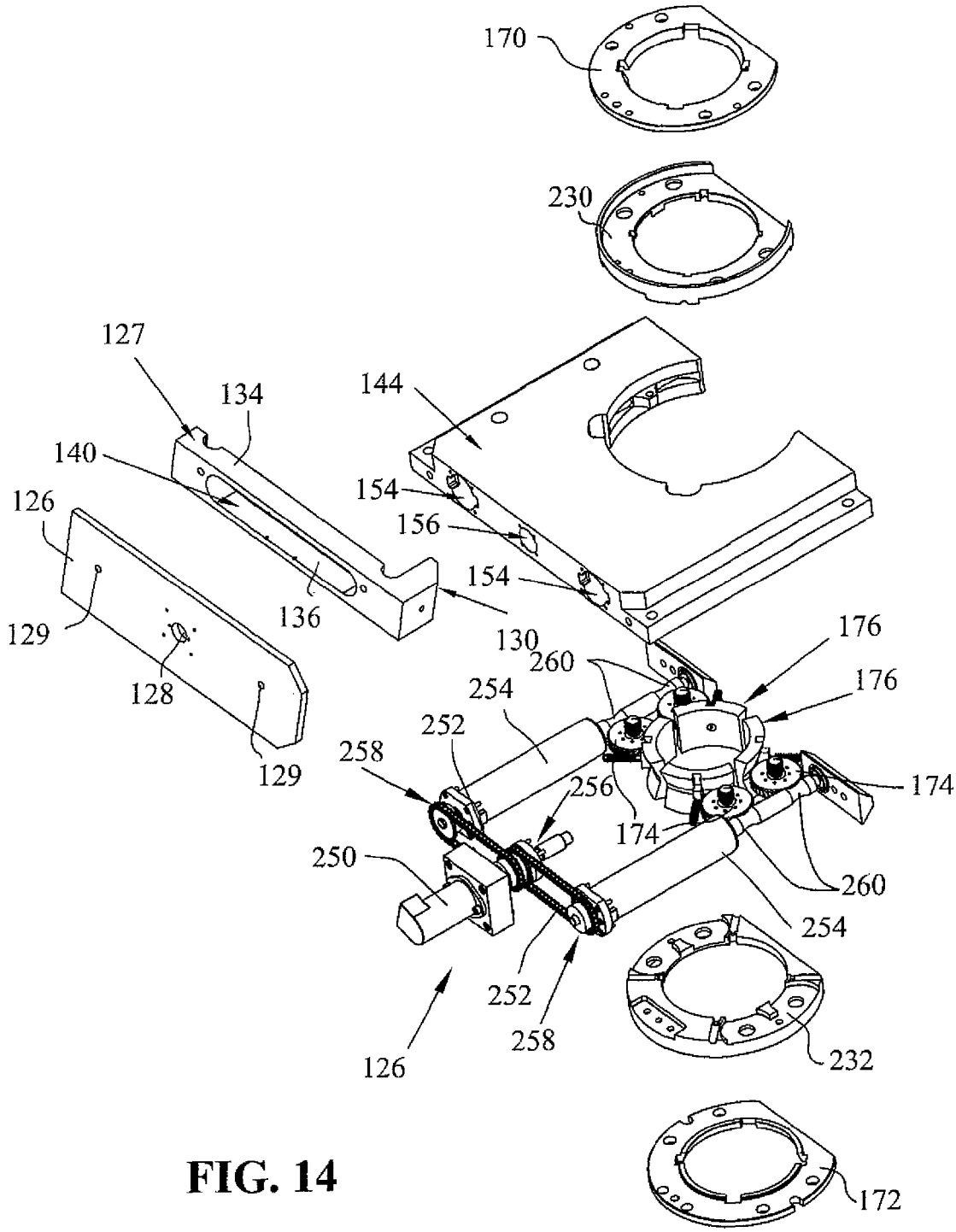
FIG. 14 depicts an exploded perspective view of a portion of the embodiment of the clamp depicted in FIG. 5.

Referring still to FIGS. 7 and 14, it should be noted that worms 254 are sized and configured to be received within the through passage 156 of main body 122. In addition, the spindle 256 and chain combination 252 are sized and configured to extend through aperture 128 of plate 126 and opening 140 of member 127, and a portion of spindle 256 will be received by truncated passage 156. In the depicted embodiment, chains 252 are located within opening 140. Chains 252 extend away from spindle 256 and engage the worms 254 at the chain mating area 258. The worms 254 extend into the through passage 156 and engage the gear portion 190 of the worm gears 174.

The assembled configuration of the clamping arrangement 146 will now be described, with reference generally to FIGS. 5 through 14. Once arrangement 146 is assembled, worm gears 174 are positioned within the receiving areas 236 of the main bodies 230, 232, as shown in FIG. 7. In doing so, the threaded members 192 (FIG. 10A) extend through the smooth apertures 242 (FIG. 12) formed in the main bodies 230, 232. In addition, a portion of the gear portions 190 (FIG. 10A) will extend outward through the openings 244 (FIG. 12) of the receiving areas 236. As depicted in FIG. 7, the clamp assemblies 176 are arranged so that the rods 202 extend through channels 234 formed in the mating of the bodies 230, 232. Rod 202 extends through the center of spring 246. Spring 246 rests against land 238 and acts upon a nut 248 connected to rod 202. Nut 248 may be connected to rod 202 in any suitable manner, such as by way of a strong adhesive, welding or threading, for example. The force provided by spring 246 on nut 248 should be sufficient to ensure the clamping members 200 are withdrawn in the direction of the bodies 230, 232.

The threaded members 192 (FIG. 10A) are threaded into the threaded apertures 180 (FIG. 9) of the plates 170, 172 located in the recessed areas 233 of bodies 230, 232. When located properly, the inside edges 182 of the plates 170, 172 contact and ride that, as the threaded members 192 rotate in a first direction, the plates 170, 172 move apart separate. The separation of the plates 170, 172 directs the inside edge 182 of the plates 170, 172 up the ramp portions 212, thereby directing the clamping members 200 away from housing 178. The movement of the threaded members 192 in the opposite direction, brings the plates 170, 172 together, allowing the inside edges 172 to travel down ramp portions 212. The clamping members 200 are withdrawn by the force asserted by spring 246 on nut 248, thereby moving members 200 in the direction of housing 178. It should be noted that housing 178 may be retained together by any suitable mechanism. For example, a plurality of fasteners (not shown) may be employed to ensure that body 230 remains connected to body 232, or portion of body 230 may be welded to a portion of body 232. Once the entire clamping arrangement 146 has been assembled, clamping arrangement 146 may be attached to housing 144 in any suitable fashion.

With reference to FIGS. 7, 8 and 14, the assembly of clamp 112 involves the positioning of spindle 256 of motor 250 through aperture 128 of plate 126. Spindle 256 also extends through opening 140 and partially into truncated passage 156. Chains 252 may be affixed upon the spindle 256 with opening 140, and the worms 254 may also be positioned within the through passage 154 opening 140. The chains 252 may be attached to the chain mating area 258 of each of the worms 254. It should be noted that once the worms 254 have been placed within through passage 154, the threads 260 of the worms 254 should engage the teeth 194 of the gear portions 190.

The above arrangement succeeds in allowing the distance separating the clamping members 200 to be altered by rotation of spindle 256. For example, rotation of spindle 256 results in the rotation of worms 254 by way of chains 252. As worms 254 rotate, the interaction of teeth 194 and threads 260 will cause worm gears 174 to also rotate. The rotation of the worm gears 174 also results in separation of plates 170, 172, due to the interaction of threaded members 197 and threaded apertures 180. As the plates 170, 172 spread apart, the plates 170, 172 interact with the ramp portions 212 of the clamping members 200, thereby forcing the clamping members 200 toward the center of a receiving area, generally indicated by numeral 270.

When spindle 256 rotates in an opposition direction, the worms 254, in turn, also rotate in the opposition direction, thereby resulting in the threaded members 197 of the worm gears 174 rotating in the opposition direction. This rotation brings the plates 170, 172 closer together. As the plates 170, 172 come together, the plates 170, 172 travel along ramp portions 212 toward groove 214. The force asserted by spring 246 against land 238 and nut 248 should be sufficient to ensure that the clamping members 200 spread apart from one another, thereby increasing the separation distance of each other and increasing the effective size of receiving area 270.

Figure 15:
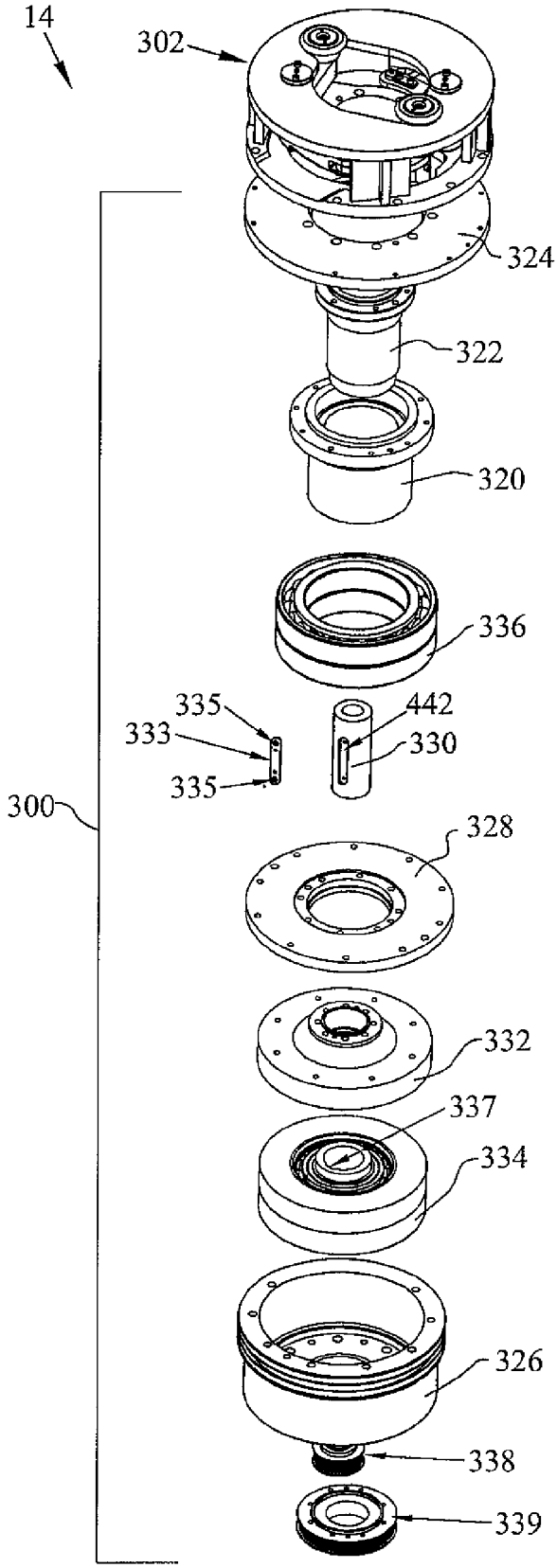
FIG. 15 depicts an exploded perspective view of a spinning arrangement utilized in an embodiment of the present invention.

With reference now to FIGS. 1 and 15, the spinning arrangement 14 includes a harmonic drive assembly 300, a spinner head 302 and a guard 304. As shown in FIG. 15, in the depicted embodiment, the harmonic drive assembly 300 includes an outer spindle 320, an inner spindle 322, an outer spindle end plate 324, a harmonic drive housing 326, a housing cover 328, a control shaft 330, a harmonic drive end cap 332, a keyway 333, a harmonic drive unit 334, a bearing package 336, a lower pulley 338 and an upper pulley 339.

Figure 16:
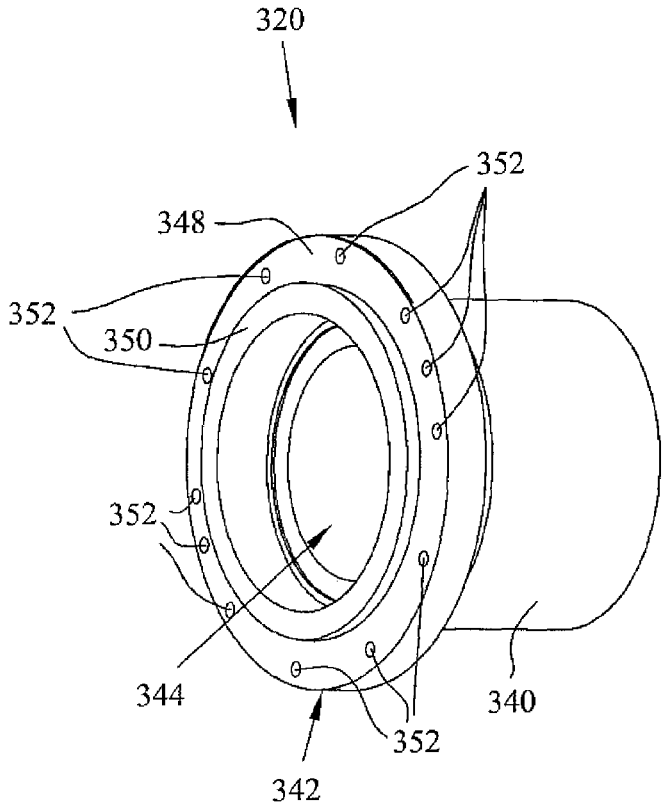
FIG. 16 depicts a perspective view of a component comprising the harmonic drive assembly depicted in FIG. 15.
Figure 17:
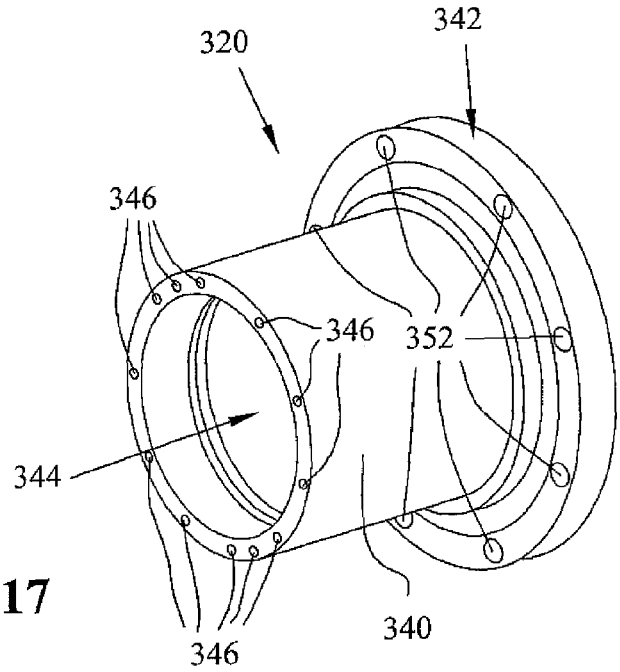
FIG. 17 depicts a rear perspective view of the component depicted in FIG. 16.

With reference now to FIGS. 16 and 17, in the depicted embodiment, outer spindle 320 may be formed from any suitable material and may include a shaft 340, a head 342 and a longitudinal passageway 344. Shaft 340 has a substantially cylindrical shape and includes a plurality of apertures 346. Head 342 may be attached to the end of shaft 340, opposite apertures 346, in any suitable manner and may be integrally formed with shaft 340. Head 342 includes a body portion 348 and a raised rib 350. Body portion 348 has a substantially circular shape and includes a plurality of apertures 352. Raised rib 350 extends upwards from body 348 and encompasses longitudinal passageway 344.

Figure 18:
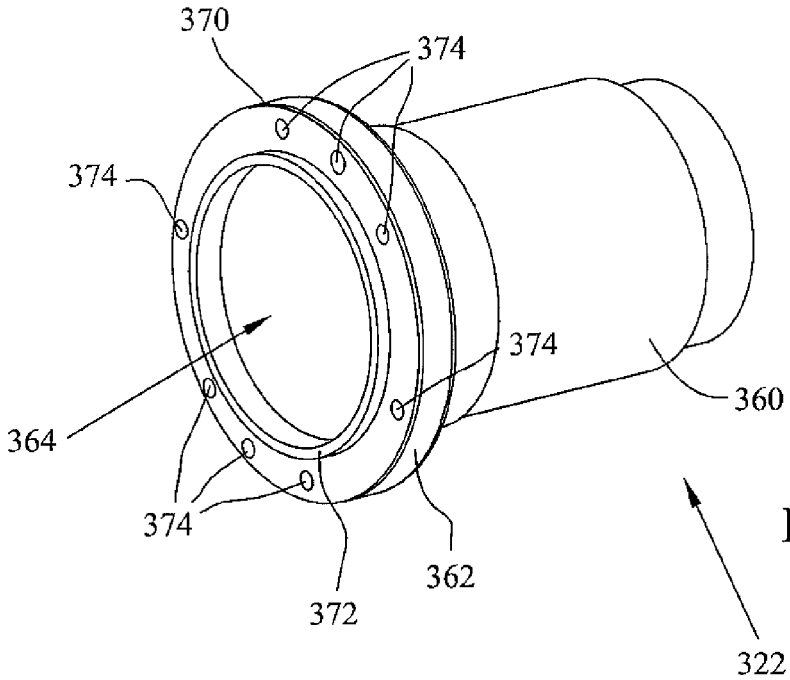
FIG. 18 depicts a perspective view of a component utilized in the harmonic drive assembly depicted in FIG. 15.
Figure 19:
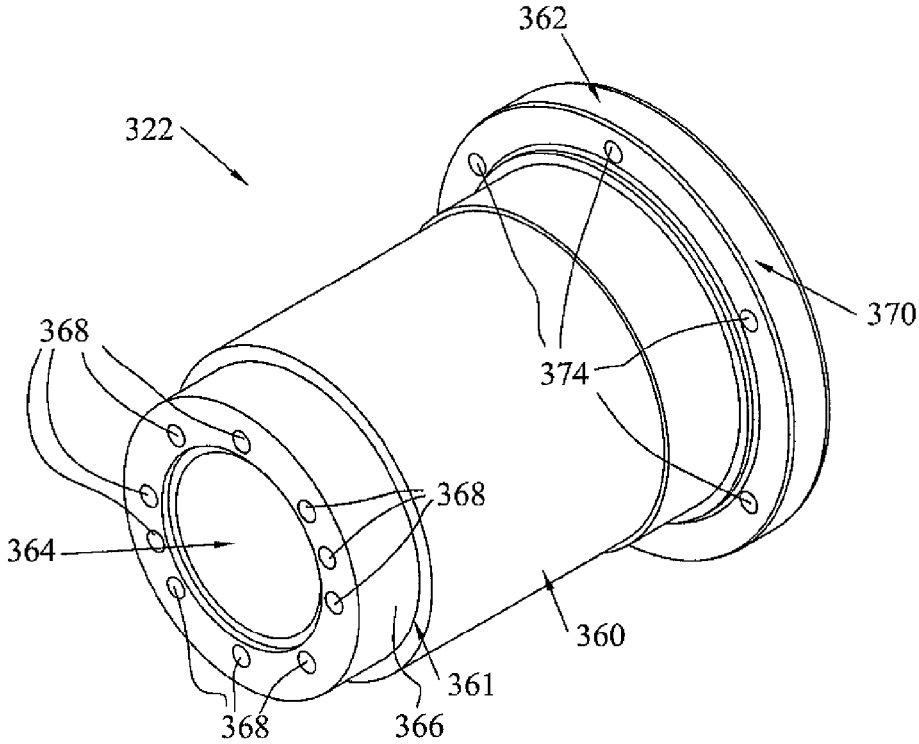
FIG. 19 depicts a rear perspective view of the component depicted in FIG. 18.

With reference now to FIGS. 18 and 19, inner spindle 322 may be formed from any suitable material and includes a shaft portion 360, a head portion 362, and a longitudinal passageway 364. Shaft portion 360 includes a step 361 formed in the outer surface 366 and a plurality of apertures, each indicated by numeral 368, formed in the end of shaft portion 360.

Head portion 362 may be attached to shaft portion 360 on the end opposite the apertures 368 in any suitable manner. Head portion 362 may be integrally formed with shaft portion 360. Head portion 362 includes a body 370 and a raised rib 372. Body 370 includes a plurality of apertures, each generally indicated by the numeral 374, and has a substantially circular shape. Raised rib 372 is integrally formed along the inner portion of body 370 and surrounds the longitudinal passageway 364. In the present embodiment, at least a portion of inner spindle 322 is sized and configured to be received within outer spindle 320.

Figure 20:
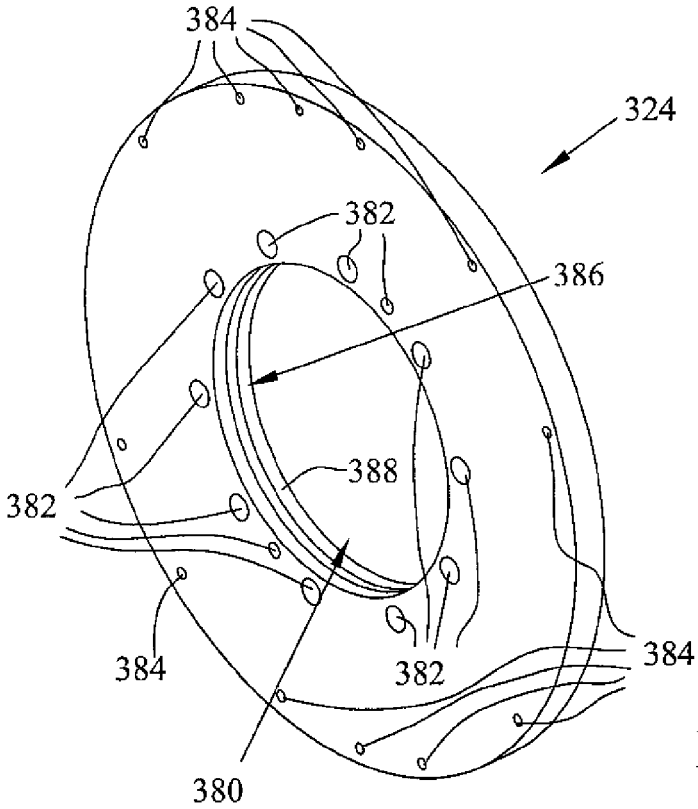
FIG. 20 depicts a perspective view of a component utilized in the harmonic drive assembly depicted in FIG. 15.

With reference now to FIG. 20, in the depicted embodiment, outer spindle end plate 324 comprises a substantially circular ring having a central aperture 380, inner mounting apertures, each indicated by numeral 382, and outer mounting apertures, each indicated by numeral 384. End plate 324 also includes an inner surface 386 comprising a stepped area 388. In the depicted embodiment of the invention, stepped area 388 is sized and configured to mate with raised rib 350 of outer spindle 320. In addition, the inner mounting apertures 382 may be positioned so as to mate with the mounting apertures 352 of outer spindle 320. In the depicted embodiment of the invention, the outer mounting apertures 384 are positioned proximate the outer edge of the outer spindle end plate 324.

Figure 21:
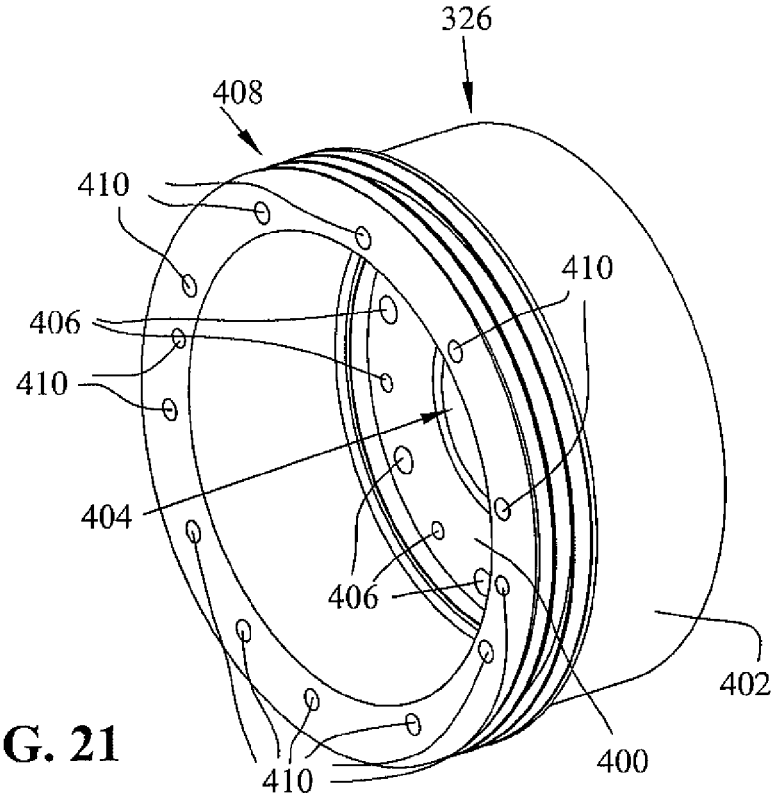
FIG. 21 depicts a perspective view of a component utilized in the harmonic drive assembly depicted in FIG. 15.
Figure 22:
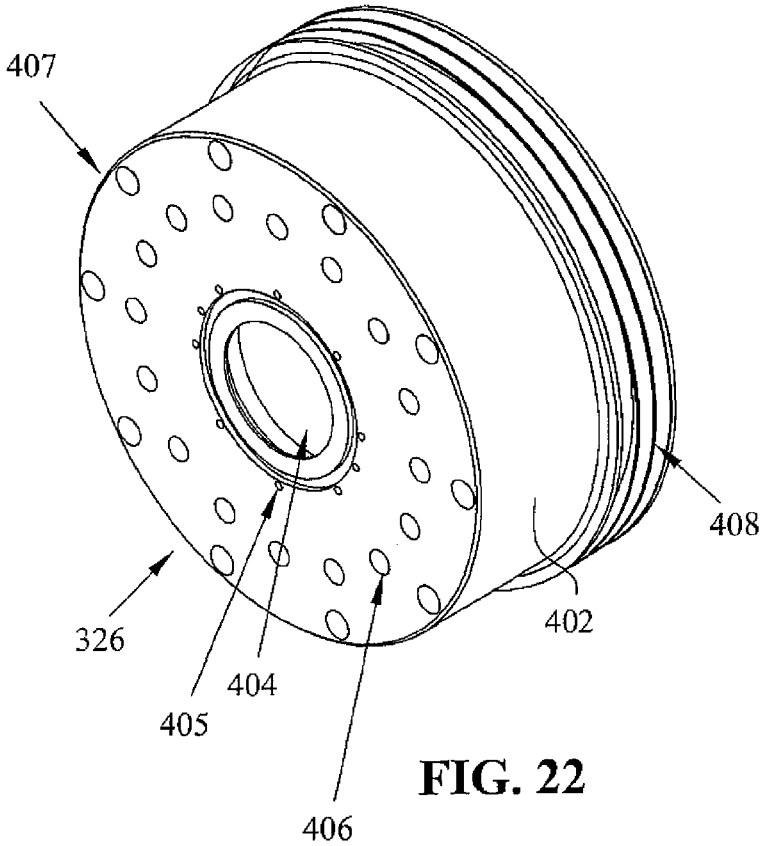
FIG. 22 depicts a rear perspective view of the component depicted in FIG. 21.

Referring now to FIGS. 21 and 22, harmonic drive housing 326 includes a floor 400 with a wall 402 having a substantially cylindrical shape. In the depicted embodiment, wall 402 extends upwards from floor 400. Floor 400 includes a stepped aperture 404 and a plurality of inner apertures, generally indicated by numeral 405, a plurality of intermediate apertures, generally indicated by numeral 406, and a plurality of outer apertures, generally indicated by numeral 407. The stepped aperture 404 extends through the approximate center of floor 400 and is encompassed by the plurality of apertures 405, 406, 407.

Wall 402 extends upwards from floor 400 in a cylindrical fashion. Wall 402 includes a plurality of grooves, generally indicated by numeral 408, and a plurality of apertures, generally indicated by numeral 410, formed in the upper surface of wall 402 opposite floor 400.

Figure 23:
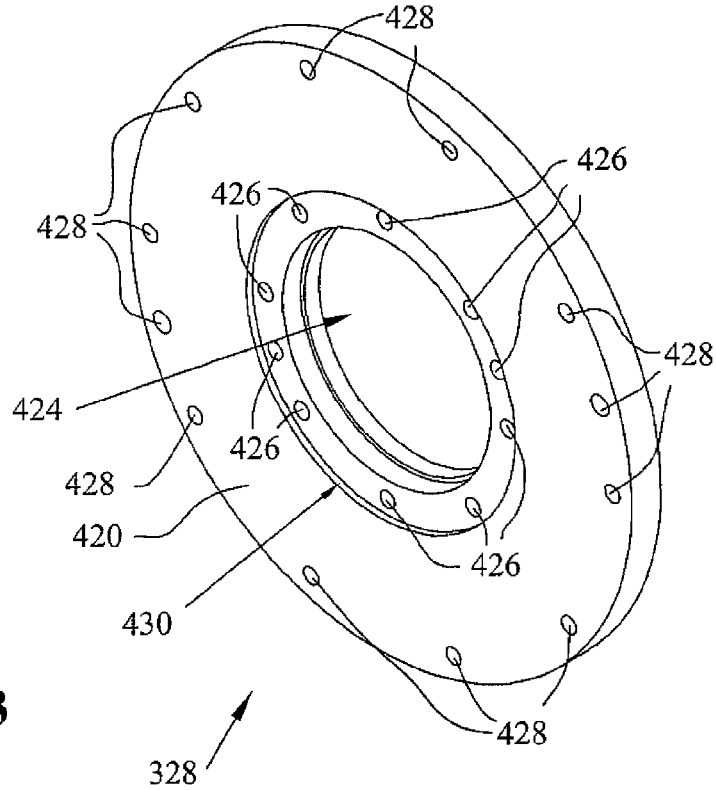
FIG. 23 depicts a perspective view of a component utilized in the harmonic drive assembly depicted in FIG. 15.
Figure 24:
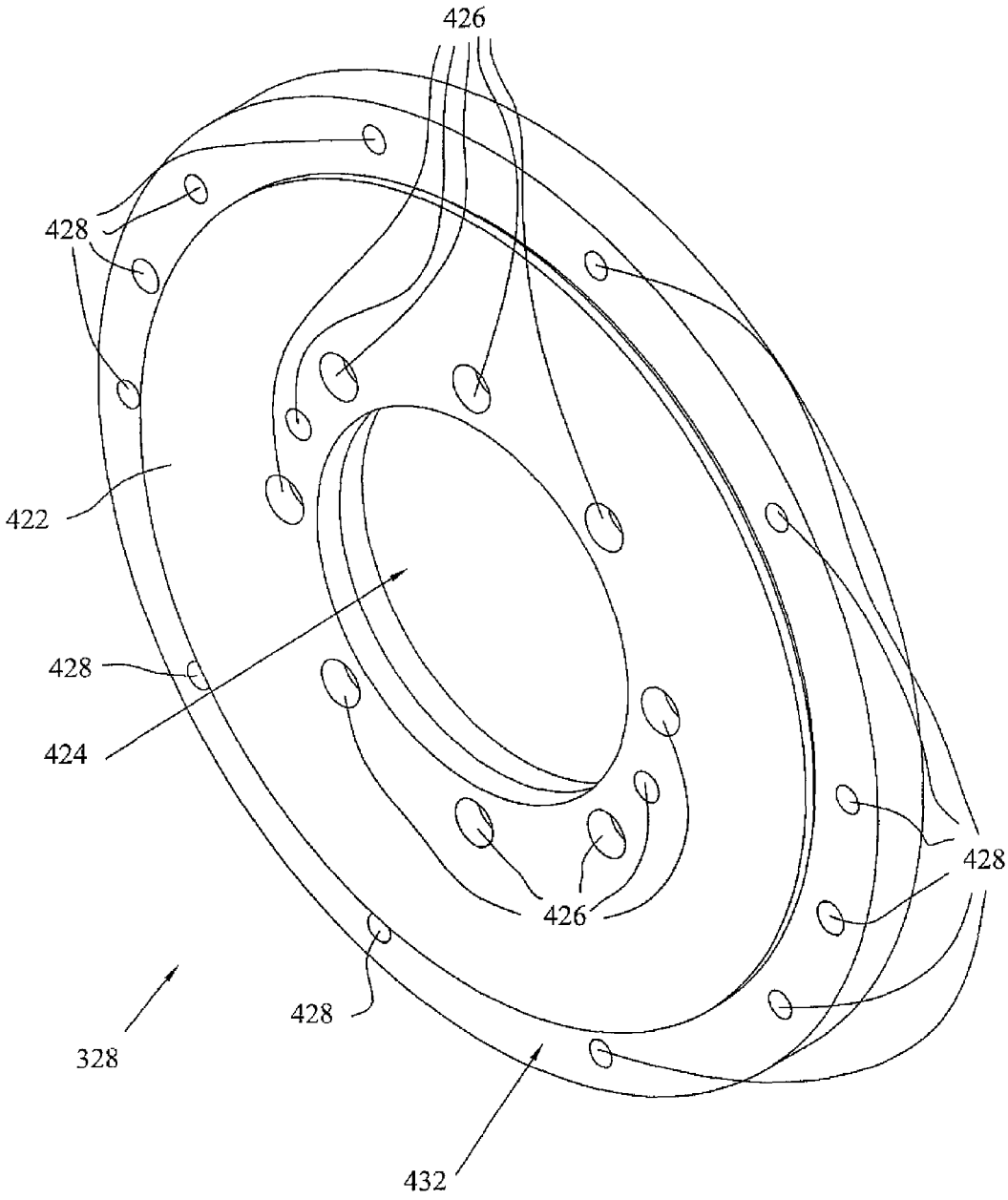
FIG. 24 depicts a rear perspective view of the component depicted in FIG. 23.

With reference now to FIGS. 23 and 24, harmonic drive housing cover 328 has a substantially circular shape including an upper surface 420, a lower surface 422, a central aperture, generally indicated by numeral 424, an inner ring of apertures, each indicated by numeral 426, and an outer ring of apertures, each indicated by numeral 428. In the depicted embodiment, central aperture 424 extends through the center of upper surface 420 and lower surface 422. Inner ring apertures 426 are positioned within a step 430 formed in outer surface 420, and encompassing central aperture 424. Similarly, outer ring apertures 428 are located proximate the edge of the harmonic drive housing cover 328. The outer ring apertures 428 are positioned within a step 432 formed in the lower surface 422. In the present embodiment of the invention, the outer ring apertures 428 coincide with apertures 410 of harmonic drive housing 326.

Figure 25:
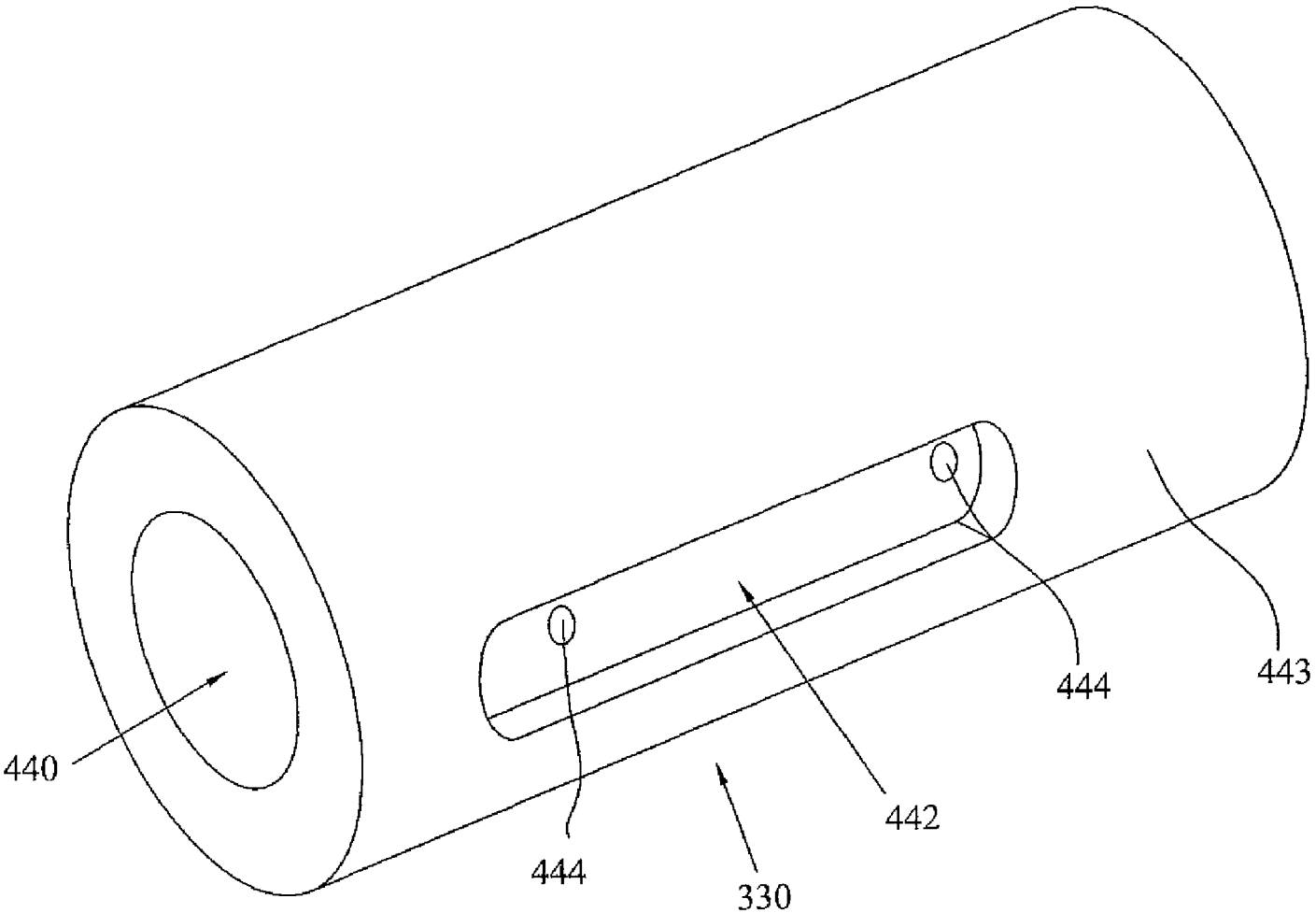
FIG. 25 depicts a perspective view of the component utilized in the harmonic drive assembly depicted in FIG. 15.

With reference now to FIG. 25, control shaft 330 may be formed from any suitable material. In the depicted embodiment, control shaft 330 has a substantially cylindrical shape and includes a longitudinal passageway 440 and a recessed area 442 and an outer surface 443. Recessed area 442 may be formed in the outer surface 443 and includes a pair of apertures 444. In the present embodiment, recessed area 442 has an elongated oval shape, and apertures 444 extend from the outer surface to passageway 440.

Figure 26:
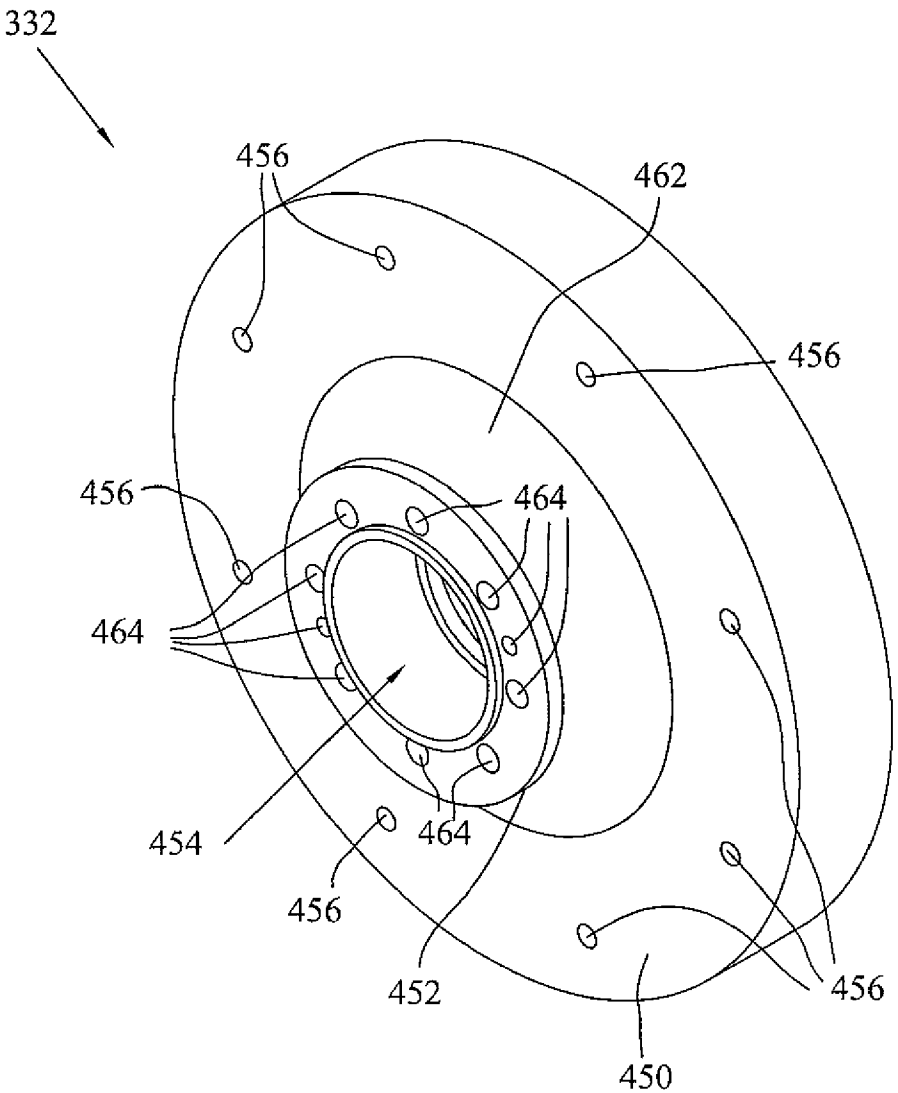
FIG. 26 depicts a perspective view of a component utilized in the harmonic drive assembly depicted in FIG. 15.
Figure 27:
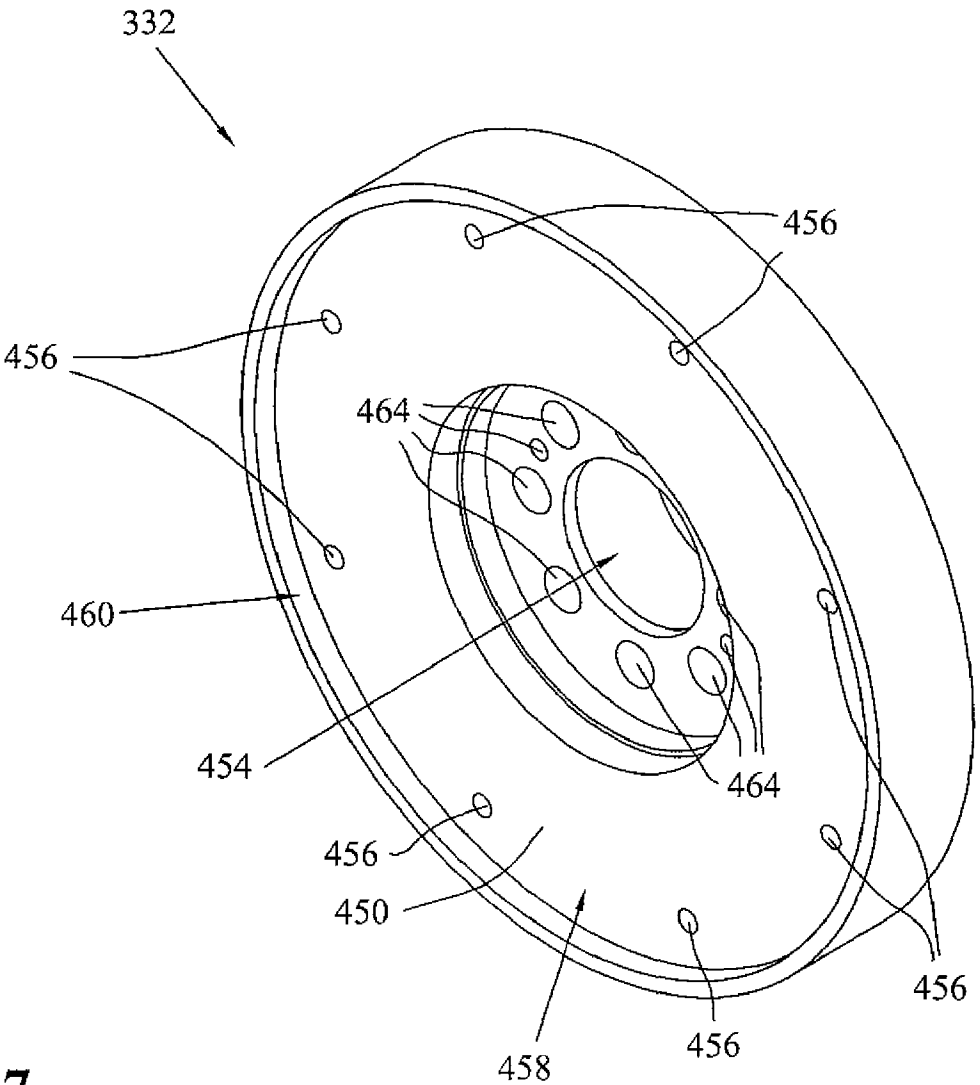
FIG. 27 depicts a rear perspective view of the component depicted in FIG. 26.

Referring now to FIGS. 26 and 27, harmonic drive end cap 332 includes a main body portion 450 and an extended portion 452. The main body portion 450 is substantially disc shaped and includes a central aperture, generally indicated by numeral 454, a plurality of mounting apertures, each indicated by numeral 456, and a recessed area 458. In the depicted embodiment, the lip 460 defines the recessed area 458.

Referring still to FIGS. 26 and 27, in the depicted embodiment, extended portion 452 includes an arcuate portion 462 and a plurality of apertures, each indicated by numeral 464. Apertures 464 are arranged in a circular configuration about aperture 454.

With reference again to FIG. 15, harmonic drive 334 may comprise any suitable type of drive, such as a harmonic drive unit, for example. It should be understood that in embodiments of the invention, the harmonic drive unit 334 may be replaced by a planetary drive gear unit, a harmonic/planetary gear drive unit, or any other suitable drive unit as should be understood by one with skill in the art.

Figure 28:
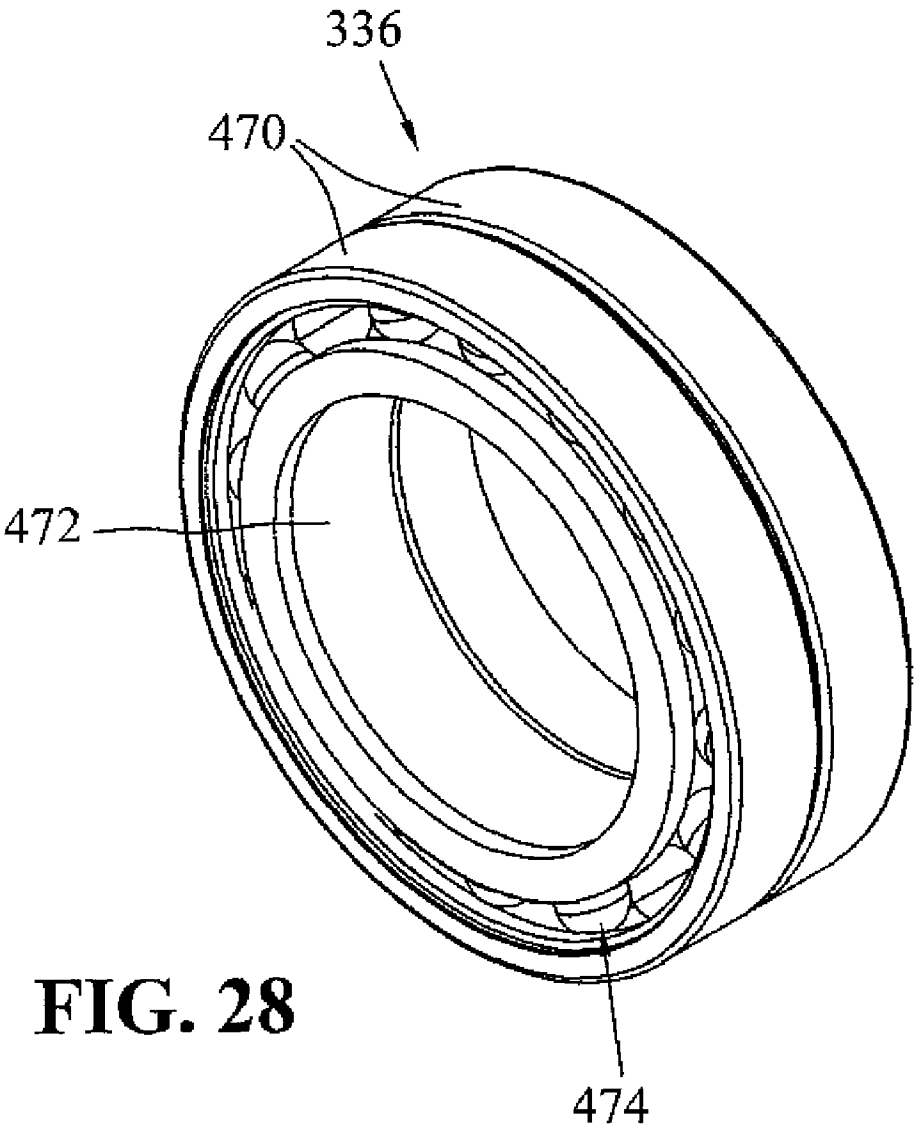
FIG. 28 depicts a perspective view of a component utilized in the harmonic drive assembly depicted in FIG. 15.

With reference now to FIG. 28, bearing package 336 includes outer races 470, inner races 472 and a plurality of bearings, generally indicated by numeral 474. Generally, bearing package 336 may be of any suitable type. In the depicted embodiment, bearings 474 are located intermediate the outer races 470 and the inner races 472, and the presence of bearings 474 allow for the movement of the outer races 470 with respect to the inner races 472.

Figure 29:
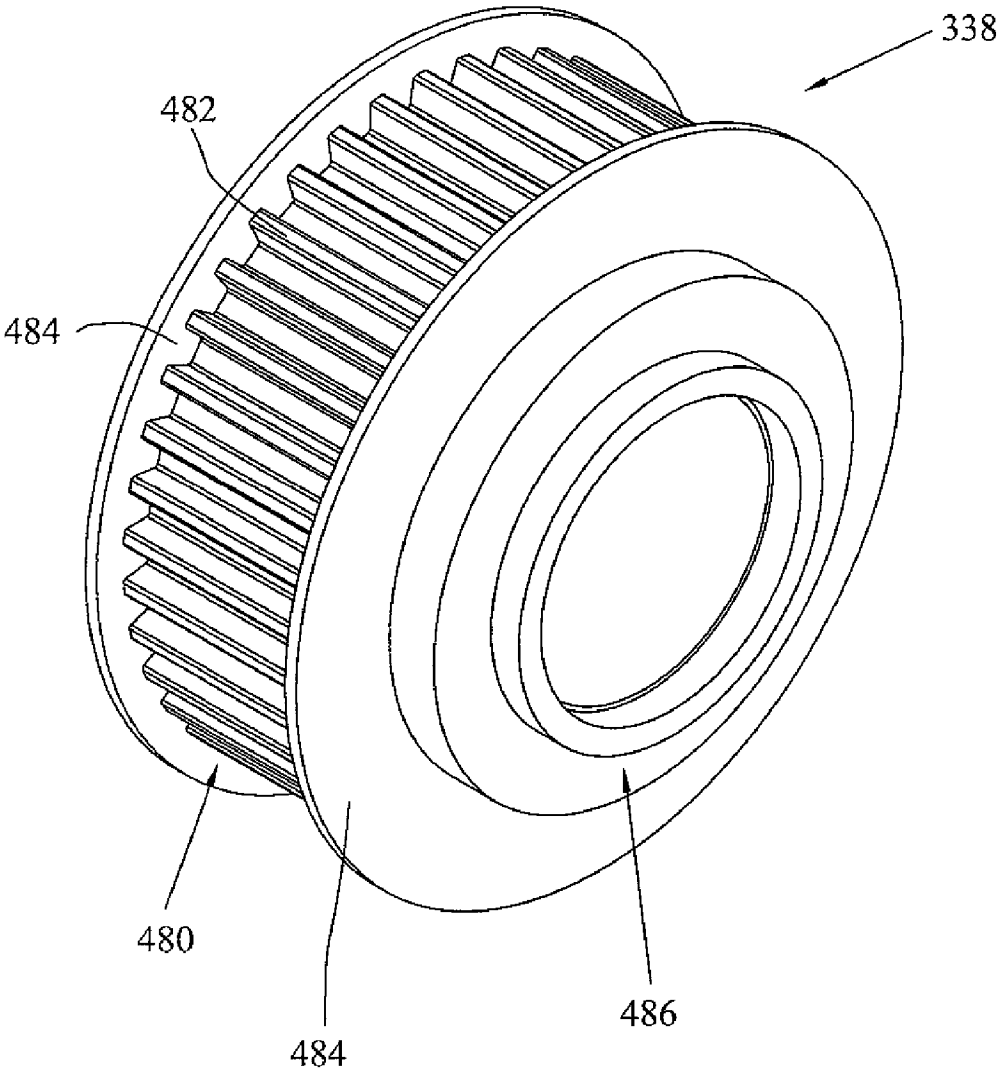
FIG. 29 depicts a perspective view of a component utilized in the harmonic drive assembly depicted in FIG. 15.

With reference now to FIG. 29, lower pulley 338 includes a belt receiving area, generally indicated by numeral 480. Receiving area 480 includes a track, generally indicated by numeral 482, located intermediate a pair of lips 484. In addition, lower pulley 338 includes a shaft mating area 486 configured to mate with control shaft 330 in any suitable manner.

Figure 30:
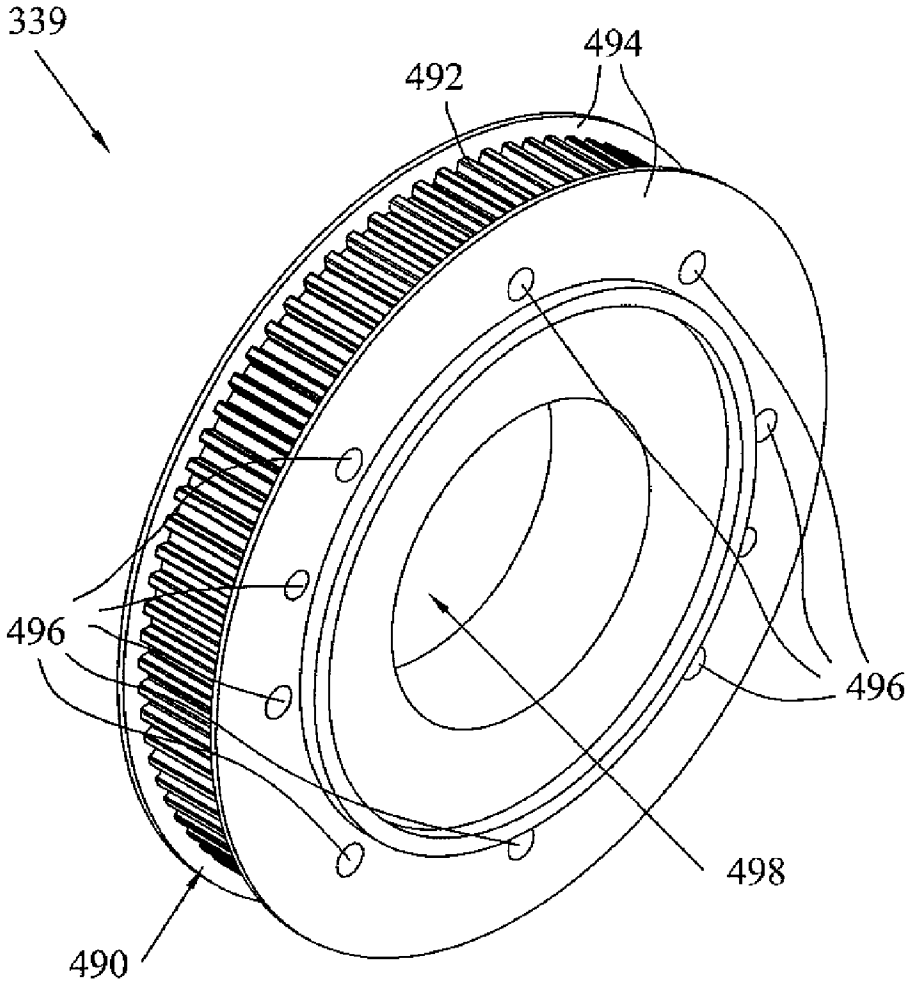
FIG. 30 depicts a perspective view of a component utilized in the harmonic drive assembly depicted in FIG. 15.
Figure 31A:
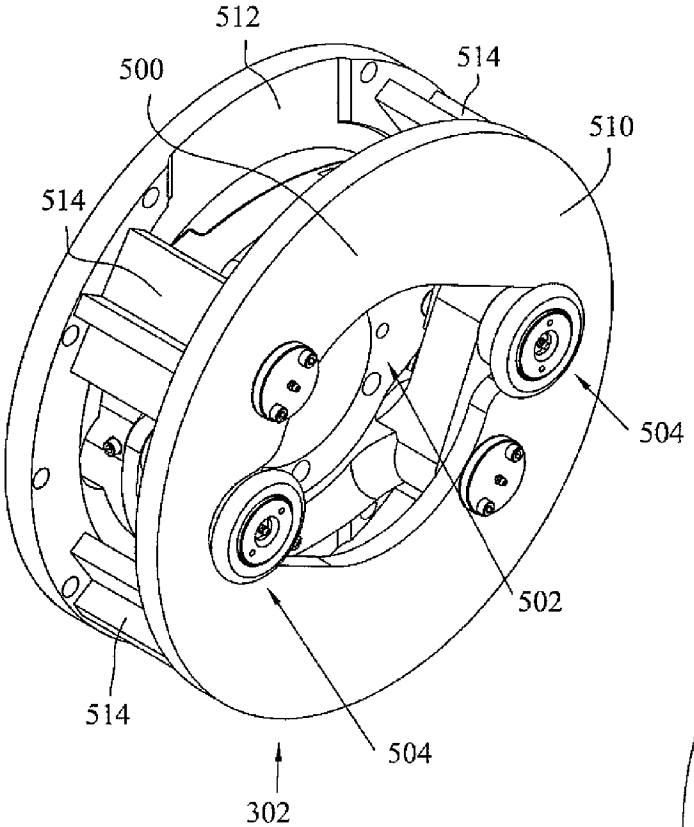
FIGS. 31A and 31B depict an embodiment of a spinner head used in embodiments of the present invention.
Figure 31B:
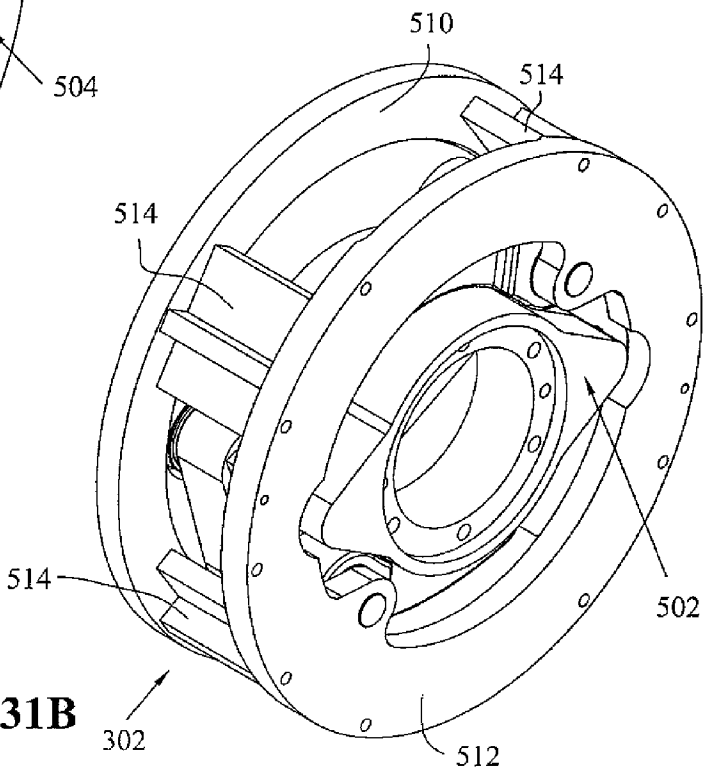
Figure 32:
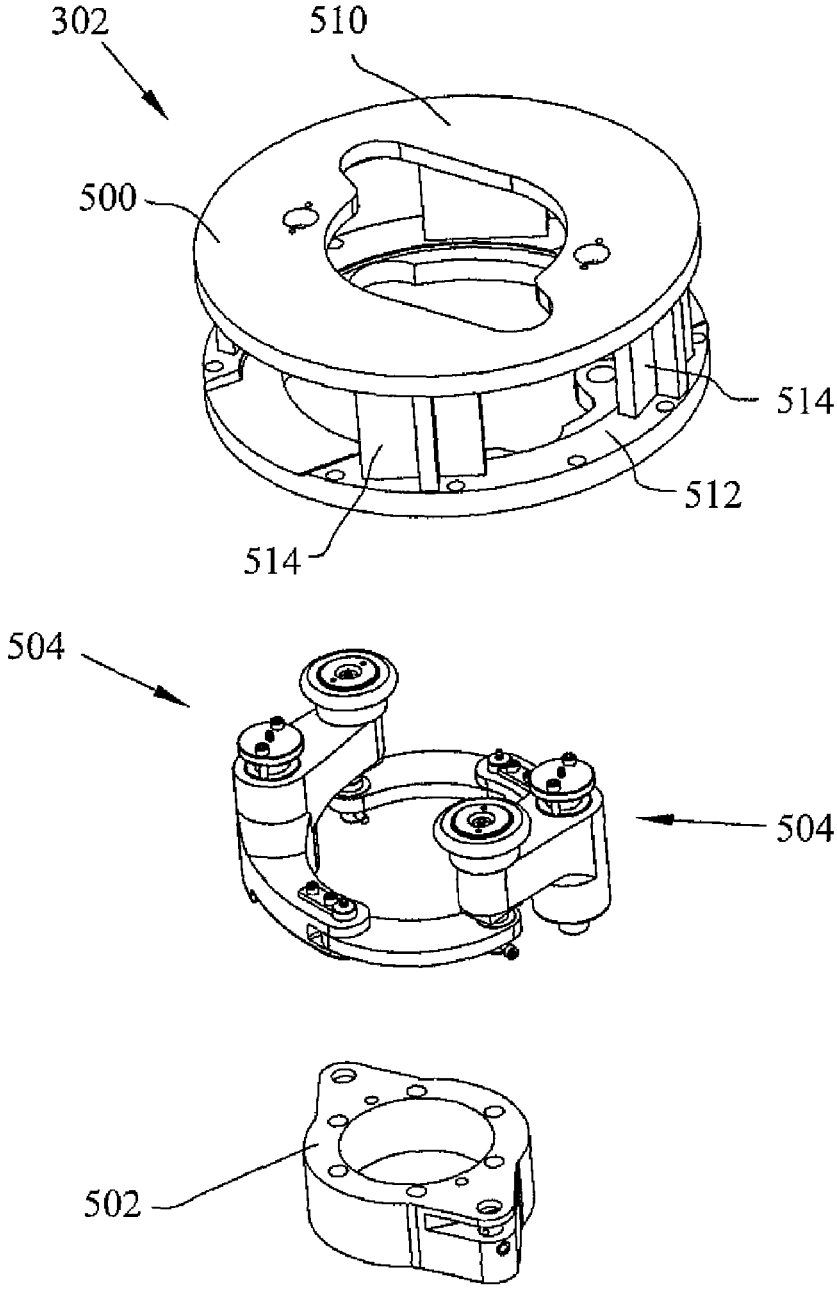
FIG. 32 depicts an exploded perspective view of the spinner head depicted in FIGS. 31A and 31B.

With reference now to FIG. 30, upper pulley 339 includes a belt receiving area, generally indicated by numeral 490, a track, generally indicated by numeral 492, a pair of lips 494, a plurality of apertures, each indicated by numeral 496 and an aperture 498. In the depicted embodiment, track 492 is located intermediate the lips 494. The apertures 496 encompass aperture 498 and are configured to mate with the inner apertures 405 formed in the floor 400 of harmonic drive housing 326.

It should be noted that in the depicted embodiment, the invention utilizes belts to engage pulleys 338, 339. In embodiments of the invention, the belts may be replaced by any suitable mechanism. For example, chains may be employed in the place of the belts, and the belt receiving areas 480, 490 of the pulleys 338, 339 may be modified so as to engage the chains.

Referring again to FIG. 15, numeral 333 generally indicates a keyway. In the depicted embodiment, keyway 333 may be formed from any suitable material and may have substantially flat side edges and rounded ends. Keyway 333 includes a plurality of apertures, generally indicated by numeral 335. Keyway 333 is sized so that at least a portion of keyway 333 may be located within recessed area 442 of shaft 330.

With reference now to FIGS. 15 through 30, the assembled arrangement of harmonic drive assembly 300 will be described. Once harmonic drive assembly 330 has been assembled, fasteners (not shown) connect upper pulley 339 to harmonic drive housing 326 by extending through apertures 405 (FIG. 22) and apertures 496 (FIG. 30). Control shaft 330 is located at least partially within aperture 404 (FIG. 21) of harmonic drive housing 326. In addition, control shaft 330 is located at least partially within central aperture 498 (FIG. 30) of upper pulley 339. Control shaft 330 may also be attached to the shaft mating area 486 (FIG. 29) of lower pulley 338 in any suitable manner, such as by fasteners (not shown) or through a welding process, for example.

Control shaft 330 may also be connected to drive unit 334 in any suitable manner. For example, a keyway 333 may attach the control shaft 330 and the drive unit 334. Specifically, keyway 333 may be located within recessed area 442 (FIG. 25) of shaft 330. A portion of keyway 333 will also extend into notch 337 of unit 334. Drive unit 334, in turn, mates with harmonic drive end cap 332 in a suitable fashion, such as with fasteners, for example. In turn, end cap 332 may be coupled to inner spindle 322 in any suitable manner. In embodiments of the invention, fasteners (not shown) may be inserted into apertures 464 (FIG. 26) of cap 332 and apertures 368 (FIG. 19) of inner spindle 322.

Harmonic drive housing cover 328 may be affixed to harmonic drive housing 326 in any suitable manner. In the depicted embodiment, fasteners (not shown) may extend through apertures 428 (FIG. 23) of the harmonic drive housing cover 328 and apertures 410 (FIG. 21) in harmonic drive housing 326 to affix the cover 328 to the housing 326.

The harmonic drive housing cover 328, in turn, may be attached to outer spindle 320. Specifically, apertures 426 (FIG. 23) of cover 328 may align with apertures 346 (FIG. 17) of outer spindle 320, and fasteners (not shown) may fasten the harmonic drive housing cover 328 to the outer spindle 320. It should be noted that this arrangement locates inner spindle 322 within outer spindle 320.

Outer spindle end plate 324 may be attached to outer spindle 320 opposite the harmonic drive housing 326. The apertures 382 (FIG. 20) of plate 324 are arranged to align with apertures 352 (FIG. 17) of outer spindle 320. Fasteners (not shown) may then attach the outer spindle 320 to plate 324.

With reference now to FIGS. 31A through 40, spinner head 302 includes a housing 500, a rotation hub 502 and a plurality of roller assemblies, each generally indicated by numeral 504. In the present embodiment, housing 500 includes an upper plate 510, a lower plate 512 and a plurality of support members 514.

Figure 33:
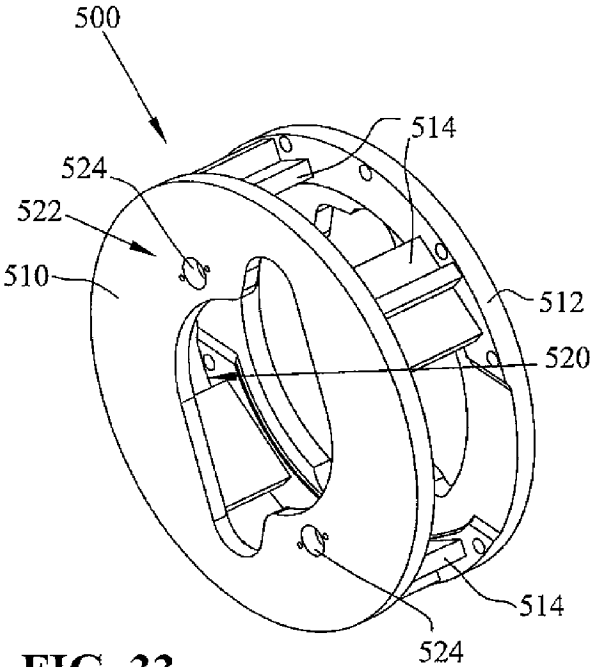
FIG. 33 depicts a perspective view of a component utilized in the spinner head depicted in FIGS. 31A and 31B.
Figure 34:
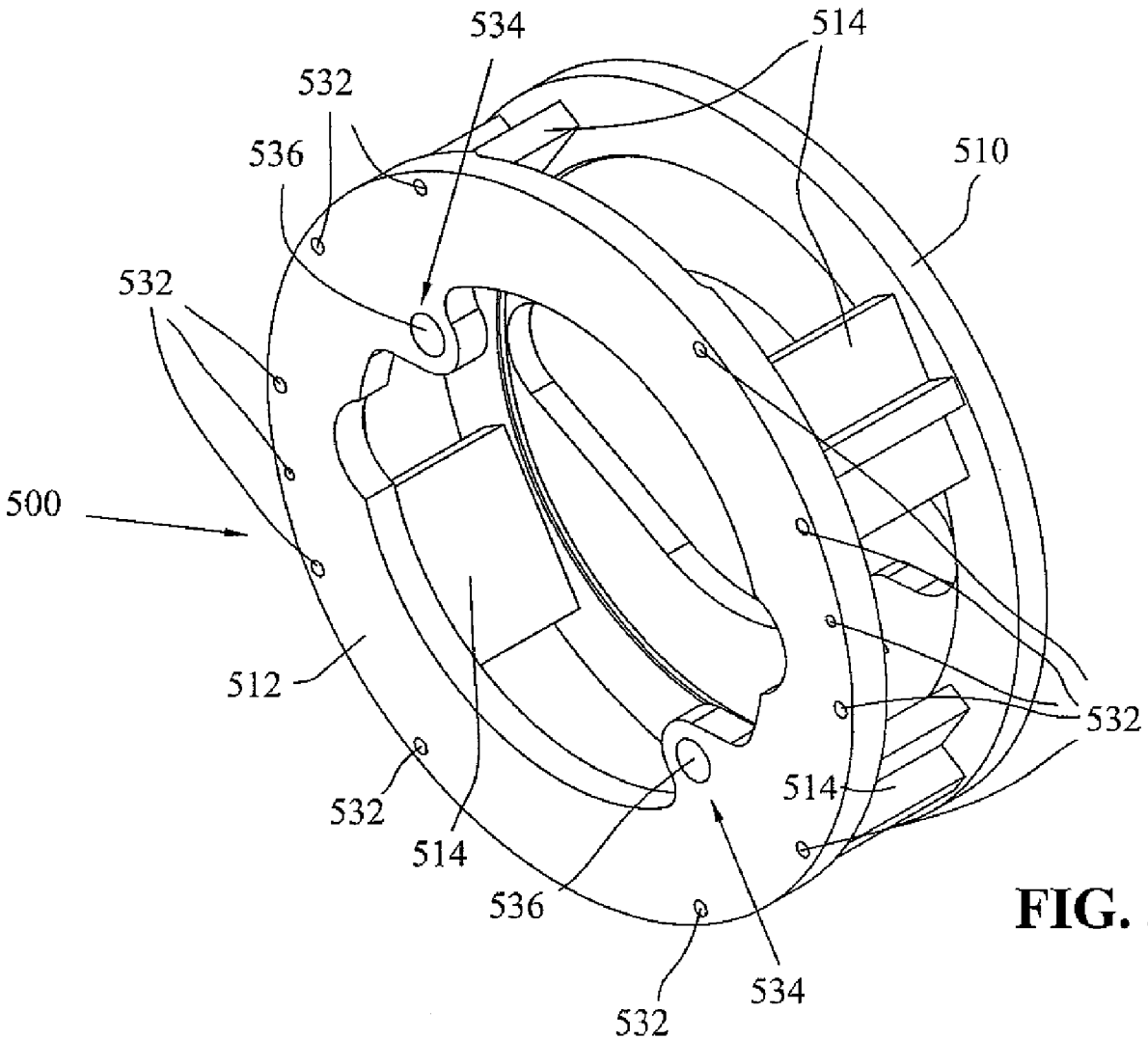
FIG. 34 depicts a rear perspective view of the component depicted in FIG. 33.

With reference now to FIGS. 33 and 34, the support members 514 may be located intermediate upper plate 510 and lower plate 512 and may be attached to the plates 510, 512 in any suitable manner, such as by welding or through the use of fasteners, for example.

Upper plate 510 includes an aperture 520 and has a substantially smooth upper surface 522. In the depicted embodiment, upper plate 510 also has a substantially circular shape and includes two apertures, each indicated by numeral 524, located on opposite sides of aperture 520.

As depicted in FIG. 34, lower plate 512 has a substantially circular shape similar to upper plate 510. Lower plate 512 includes a central opening 530, a plurality of apertures, generally indicated by numeral 532, spaced proximate the outside edge of the plate 512, and ears, each indicated by numeral 534, that extend into opening 520. Each of the ears 534 includes an aperture 536. The apertures 536 substantially align with apertures 524 of upper plate 510.

Figure 35:
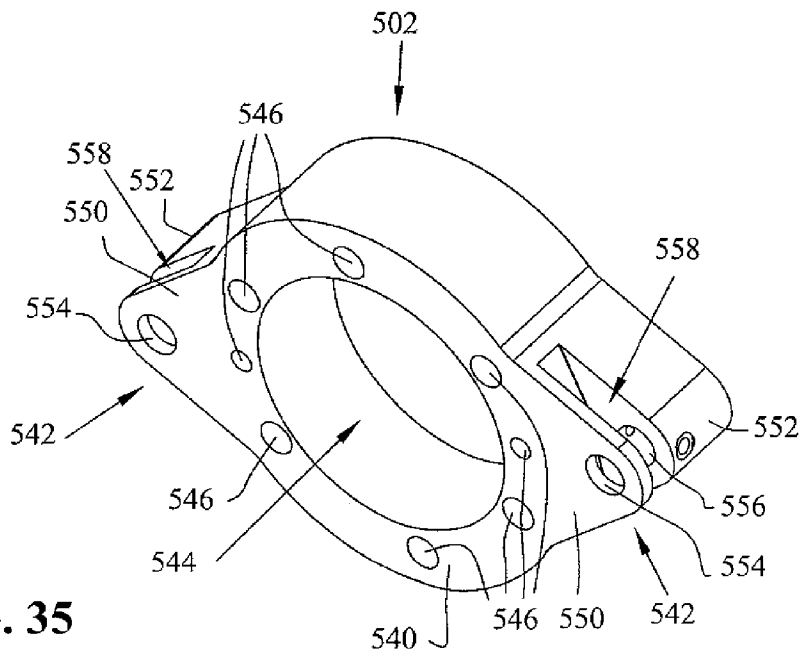
FIG. 35 depicts a perspective view of a component utilized in the spinner head depicted in FIGS. 31A and 31B.
Figure 36:
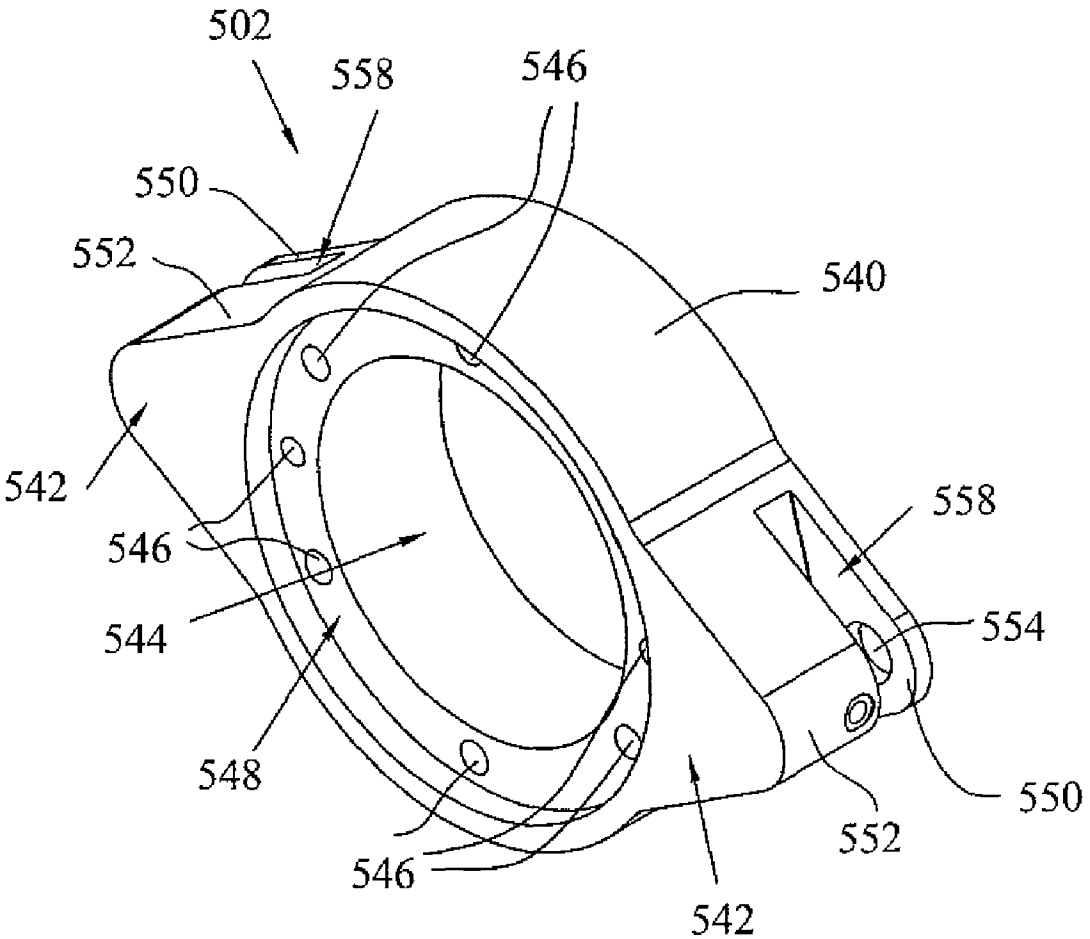
FIG. 36 depicts a rear perspective view of the component depicted in FIG. 35.

With reference now to FIGS. 35 and 36, hub 502 includes a body portion 540 and a pair of extensions, each generally indicated by numeral 542. Body portion 540 includes a central aperture 544 and a plurality of mounting apertures, each indicated by numeral 546. In the depicted embodiment, the mounting apertures 546 substantially surround central aperture 544. Body portion 540 further includes a recessed area 548 formed on its underside, Recessed area 548 includes the mounting apertures 546.

Extensions 542 each include a first portion 550 and a second portion 552 having similar shapes. In the depicted embodiment, first portion 550 is thinner than second portion 552. First portion 550 includes an aperture 554, and second portion 552 includes an aperture 556. In the depicted embodiment, the aperture 554 substantially aligns with the aperture 556. The area intermediate first portion 550 and second portion 552 corresponds to a gap, generally indicated by numeral 558.

As shown in FIGS. 37 through 40, roller assemblies 504 include a link arm 570, a connector link 572, a pivot 574, and a roller 576. In the depicted embodiment, link arm 570 includes a body portion 580 and an extension 582 extending away from body portion 580. Body portion 580 includes a first aperture 584 and a second aperture 586. First aperture 584 is positioned proximate the end of body portion 580 opposite extension 582, and second aperture 586 is located within body portion 580 at a position proximate where extension 582 connects to body portion 580.

In the depicted embodiment, extension 582 extends away from body portion 580 proximate the lower edge of the body portion 580. Extension 582 includes a first member 590 and a second member 592. First member 590 and second member 592 are spaced apart and define a receiving area, generally indicated by numeral 594. First member 590 includes an aperture 596, and second member 592 includes an aperture 598. In the depicted embodiment, aperture 596 is substantially in alignment with aperture 598. It should be noted that extension 582 and body portion 580 are integrally formed in the depicted embodiment. In other embodiments, it is anticipated that body portion 580 and extension 582 may comprise separate components joined in any suitable manner.

Figure 39:
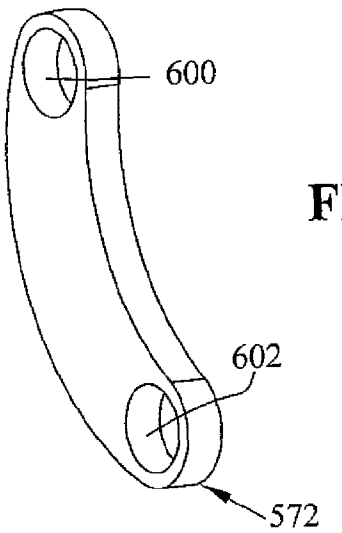
FIG. 39 depicts a perspective view of a component comprising the component assembly depicted in FIG. 37.

With reference to FIG. 39, connector link 572 represents a flat member having a substantially arcuate shape. Connector link 572 includes a first aperture 600 and a second aperture 602. The apertures 600, 602 are located proximate the ends of the connector link 572.

Figure 40:
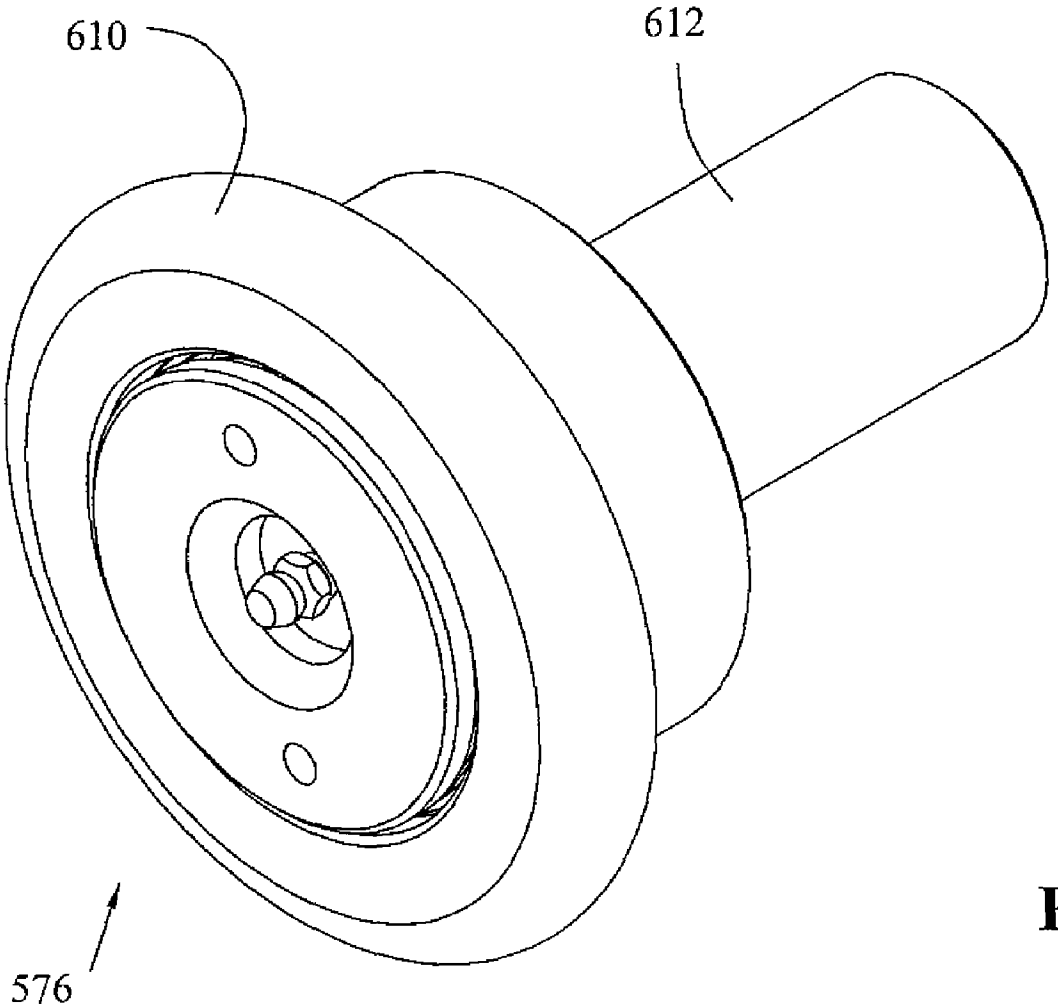
FIG. 40 depicts a perspective view of a component comprising the component assembly depicted in FIG. 37.

With reference to FIG. 40, tool 576 may be of any type known in the art suitable for the desired application. In the depicted embodiment, tool 576 represents a roller configured to form a workpiece. In embodiments of the invention, tool 576 may be any suitable tool, such as a cutting tool, for example. In the depicted embodiment, roller 576 includes a roller member 610 and an axle 612. Roller member 610 is mounted upon axle 612 such that roller member 610 may rotate on the axle 612.

With reference again to FIGS. 37 through 40, once roller assemblies 504 have been fully assembled, the rollers 576 are positioned within second aperture 586 of link arm 570. Specifically, axle 612 extends into aperture 586 and is retained therein in any suitable manner. In addition, pivot 574 extends into aperture 584 of link arm 570 in a manner allowing link arm 570 to rotate about pivot 574. Fasteners (not shown) may be employed to connect connector link 572 to link arm 570. In the depicted embodiment, a fastener 591 may extend through the apertures 596, 598 of the extension 582 and aperture 600 of connector link 572, in order to affix connector link 572 to link arm 570.

Referring again generally to FIGS. 31A through 40, in the final assembly of spinner head 302, the rollers assemblies 504 are assembled as described previously. In addition, the pivots 574 are located within apertures 524 (FIG. 33), 536 (FIG. 34), 584 (FIG. 38). Similarly, fasteners (not shown) connect the second apertures 602 (FIG. 39) of the connector links 572 to the rotational hub 502. In the depicted embodiment, the end of the connector link 572 proximate second aperture 602 is positioned within gap 558 (FIG. 35) of rotational hub 502. A fastener (not shown) may then be employed to connect the connector link 572 to the rotational hub 502 by extending through the apertures 554 (FIG. 35), 602 (FIG. 39) and into receiving area 556 (FIG. 35). It should be noted that in the depicted embodiment, the plates 510, 512 (FIG. 33) of housing 500 may be interconnected in any suitable manner.

Referring now to FIG. 15, spinner head 302 may be attached to the harmonic drive 300 in any suitable manner. In the depicted embodiment, mounting apertures 546 (FIG. 36) present within recessed area 548 of rotational hub 502 may mate with apertures 374 (FIG. 19) of body 370 of inner spindle 322. Similarly, apertures 532 (FIG. 34) of housing 500 may mate with outer mounting apertures 384 (FIG. 20) of outer spindle end plate 324. Fasteners (not shown) may be employed to attach the inner spindle 322 to the rotation hub 502. In addition, fasteners (not shown) may be employed to attach the outer spindle end plate 324 to the housing 500.

The described arrangement allows for the rotation of roller members 610 about the longitudinal axis of spinner head 302 when the spindles 320, 322 rotate. When inner spindle 322, however, rotates at a speed differing from that of outer spindle 320, rotational hub 502 will rotate relative to that of housing 500. The rotation of rotational hub 502 relative to housing 500 causes the distance separating the roller members 610 to change based upon the relative rotations of the hub 502 and housing 500. As hub 502 and housing 500 are connected to the inner spindle 322 and outer spindle 320, respectively, the relative rotations of the inner spindle 322 to the outer spindle 320 will also result in a change in the distance of separating the roller members 610.

Figure 41:
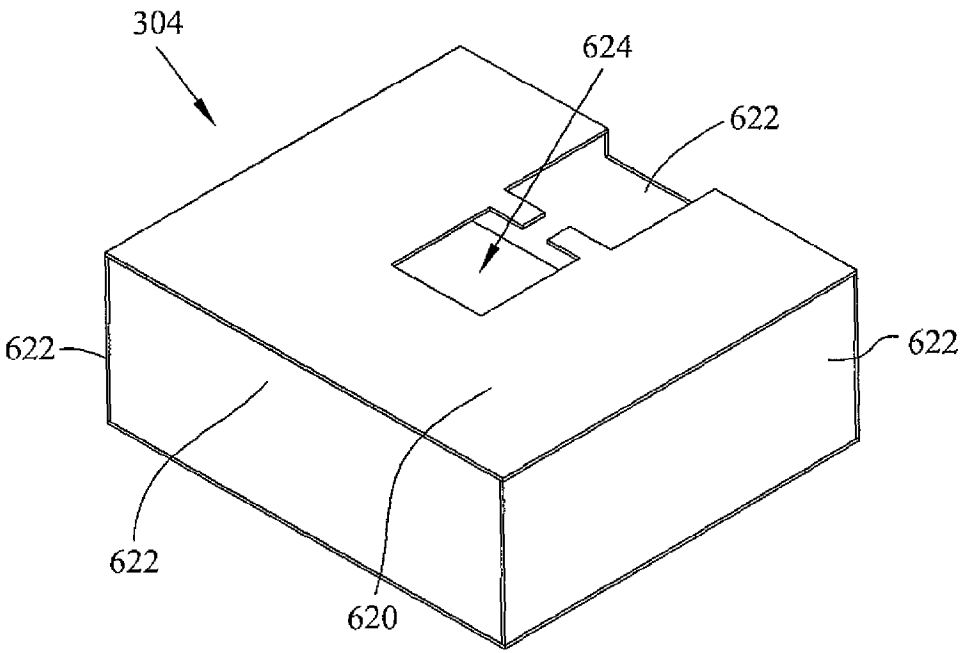
FIG. 41 depicts a perspective view of a guard utilized in embodiments of the present invention.

With reference now to FIG. 41, the depicted embodiment of guard 304 includes a horizontal plate 620 and a plurality of vertical plates 622. The vertical plates 622 extend downward from the side edges of the horizontal plate 620. Horizontal plate 620 has a substantially rectangular shape, as do the vertical plates 622. In the depicted embodiment, horizontal plate 620 includes an opening, indicated by numeral 624, located substantially in its center. Guard 304 may be manufactured of any suitable material, and the plates 622 may be attached to plate 620 in any suitable manner. In embodiments of the invention, guard 304 may further include an additional horizontal plate (not shown) attached to the lower edges of the vertical plates 622.

Figure 42:
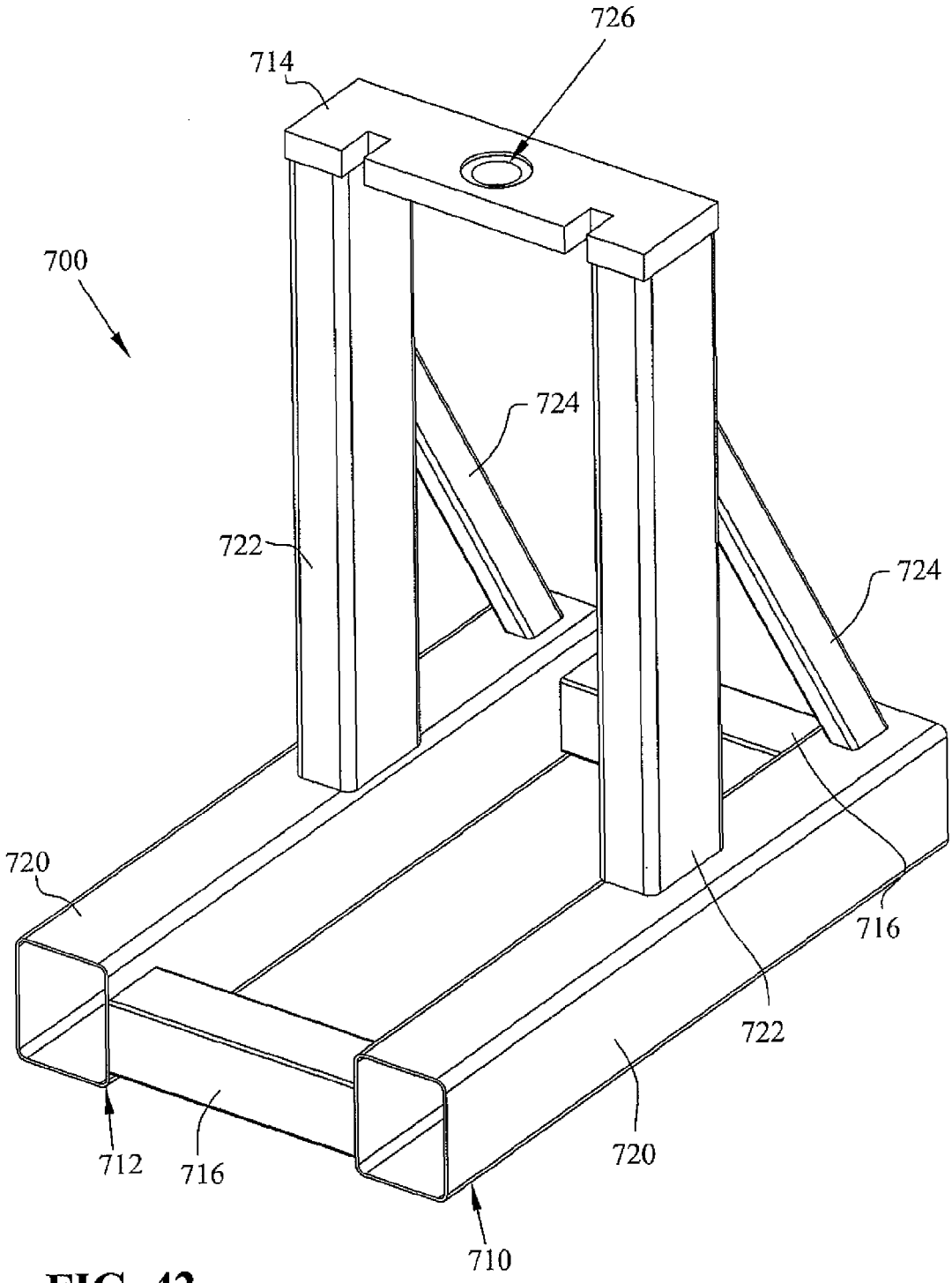
FIG. 42 depicts a perspective view of a support structure utilized in embodiments of the present invention.

With reference to FIGS. 1, 2 and 42, in the depicted embodiment of the invention, frame 16 includes a machine structure, generally indicated by numeral 700, and a spindle housing, generally indicated by numeral 702. In the present embodiment, the machine structure 700 includes a first structure 710, a second structure 712, and a connector 714.

In the depicted embodiment, first structure 710 and second structure 712 are mirror images of each other. Each of the structures 710, 712 includes a base 720, an upright member 722, and an angled support member 724. In the depicted embodiment, each of these components must be sufficiently rigid in order to ensure that when assembled, the structures 710, 712 may be capable of supporting the entire machine 10. The bases 720 of the structures 710, 712 lay upon the floor in a substantially horizontal fashion and support the machine 10 above the ground. The upright members 722 extend upwards from the bases 720 and may be attached to the bases 720 in any suitable manner. The angled support members 724 extend forward from the rear edge of bases 720 to the upright members 722. The angled support members 724 may be attached to both the bases 720 and the upright members 722 in any suitable manner.

Connector 714 connects the upper end of the upright members 722 of the structures 710, 712 together. In the present embodiment, connector 714 includes an aperture 726, and may be affixed to the members 722 in any suitable manner.

Machine structure 700 may further include at least one ground support member 716 extending between the bases 720 of the structures 710, 712. In the depicted embodiment, two ground support members 716 are employed, one proximate the front of the machine 10, and one proximate the rear of the machine 10. The members 716 may be attached to the bases 720 in any suitable manner. Embodiments of the invention may include any suitable number of ground support members 716.

Figure 43:
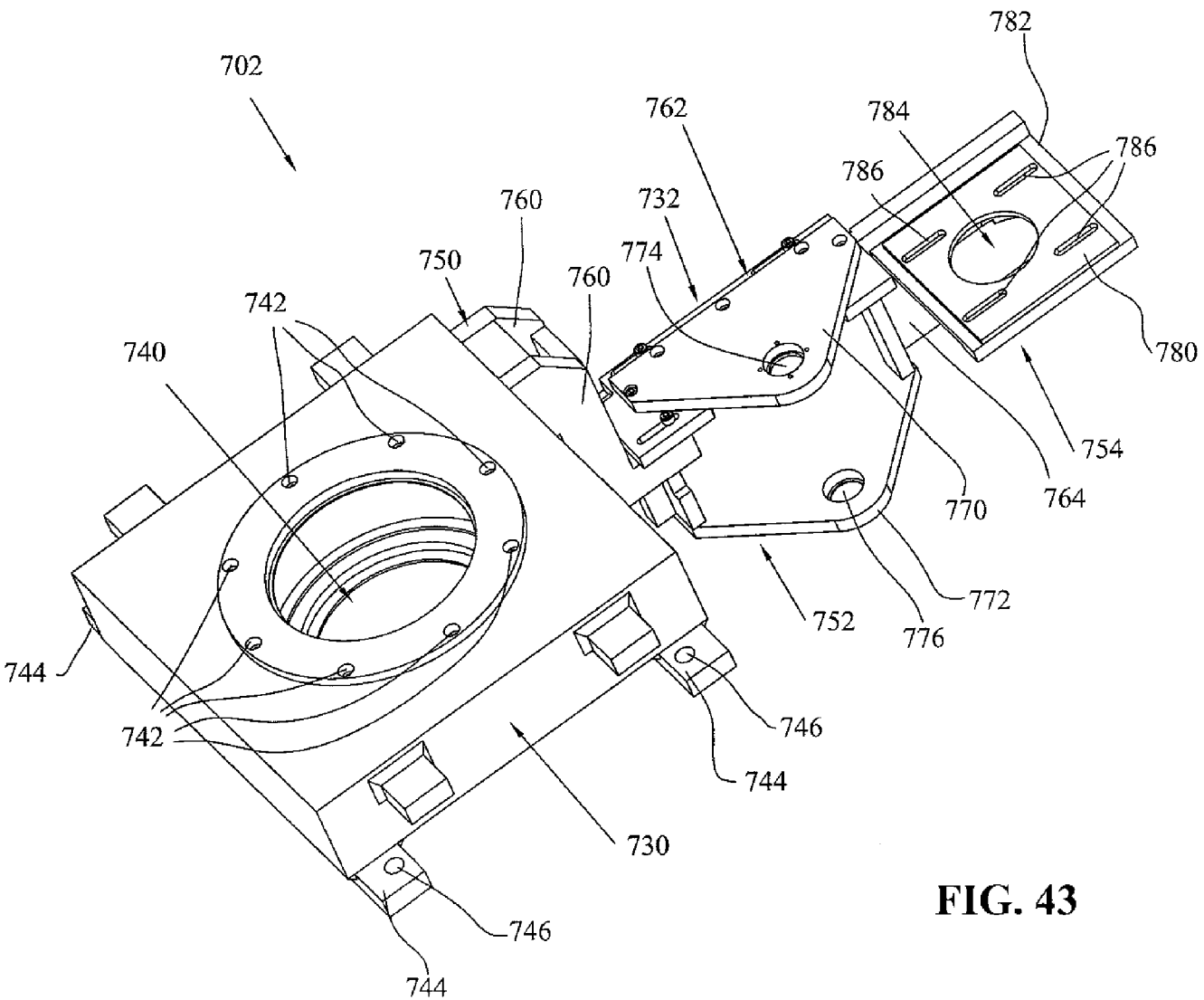
FIG. 43 depicts a perspective view of a spindle housing utilized in embodiments of the present invention.
Figure 44:
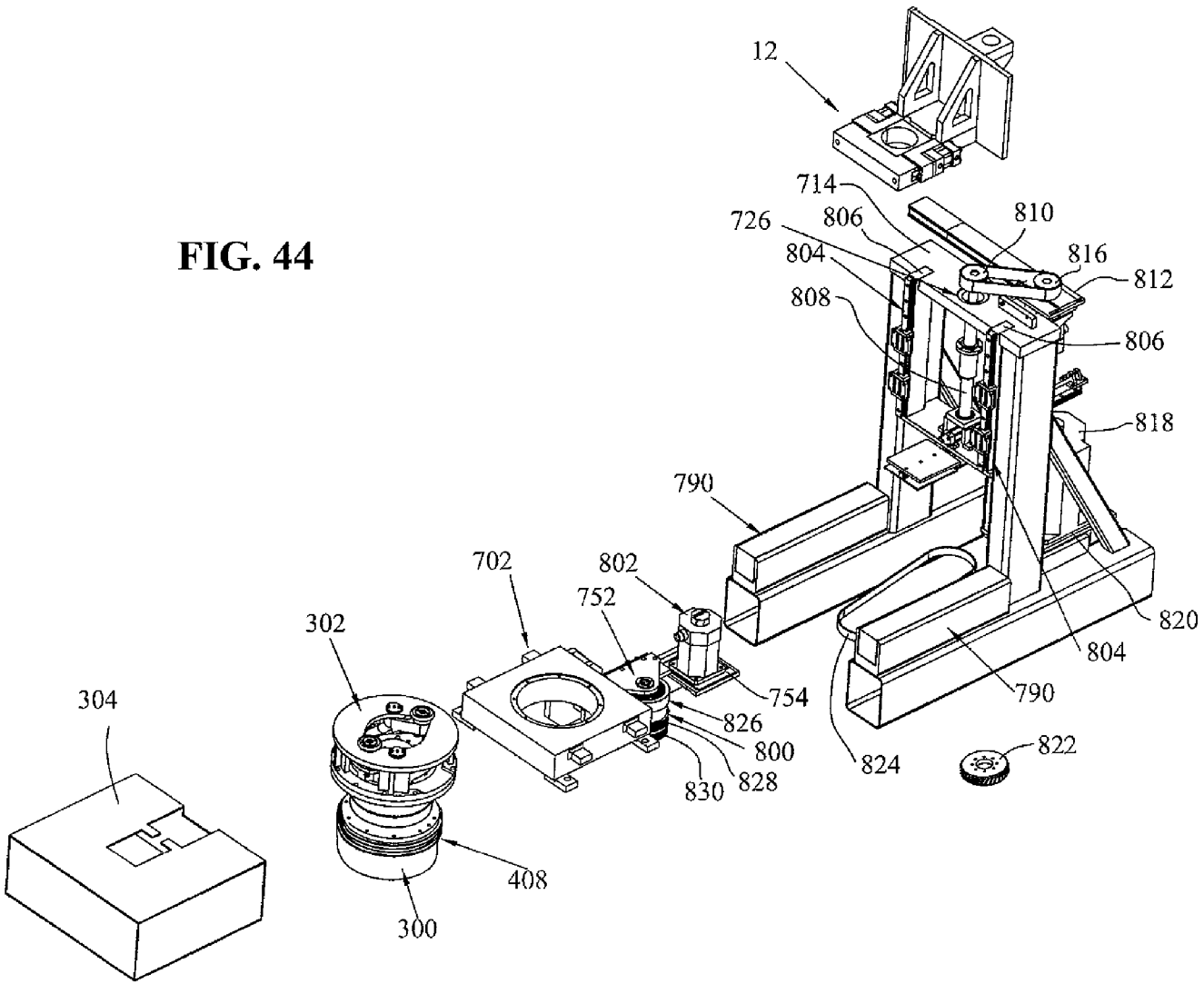
FIG. 44 depicts an exploded perspective view of an embodiment of the present invention.

As shown in FIG. 43, spindle housing 702 includes a spindle bracket 730 and a drive bracket 732. The spindle bracket 730 includes a central aperture 740 and a plurality of mounting apertures, each indicated by numeral 742. In the present embodiment the mounting apertures 742 encompass the central aperture 740, and the central aperture 740 is sized and configured to receive at least a portion of the spinning arrangement 14.

Spindle bracket 730 includes a pair of plates, each indicated by numeral 744. The plates 744 may be manufactured from any suitable material and each includes an aperture 746.

Drive bracket 732 includes a connector portion, indicated by numeral 750, a differential bracket 752 and a motor bracket 754. The connector portion 750 includes a pair of vertical members 760 and a horizontal portion 762. The vertical members 760 extend downward from the lower edge of spindle bracket 730, and the horizontal portion 762 extends outward away from the vertical members 760 in the direction opposite spindle bracket 730. In the depicted embodiment, horizontal portion 762 includes a plate 764. Vertical members 760 and horizontal portion 762 may be manufactured from any suitable material, and vertical members 760 may be attached to spindle bracket 730 by way of any suitable means, such as welding, for example. In embodiments of the invention, it is anticipated that the vertical members 760 and horizontal portion 762 may be manufactured to form a unitary component.

Differential bracket 752 may be connected to the larger plate 764 of horizontal portion 762. In the depicted embodiment, differential bracket 752 includes an upper plate 770 and a lower plate 772. The upper plate 770 is attached to the top edge of larger plate 764, and the lower plate 772 is attached to the lower edge of larger plate 764. Upper plate 770 and lower plate 772 each extend away from larger plate 764 in the same direction. Upper plate 770 includes an aperture 774, and lower plate 772 includes an aperture 776. The plates 770, 772 may be attached to the larger plate 764 in any suitable fashion, such as by welding or with a plurality of fasteners (not shown), for example.

With reference still to FIG. 43, in the depicted embodiment, motor bracket 754 is attached to horizontal portion 762 opposite the vertical members 760. Motor bracket 754 includes a flat plate 780 and an angle iron 782. In the depicted embodiment, flat plate 780 includes a central aperture 784 and a plurality of mounting apertures 786. The mounting apertures 786 encompass the central aperture 784 at various locations.

The angle iron 782 is configured to support the flat plate 780 in any suitable manner and may be affixed to flat plate 780 in any suitable manner. Angle iron 782 includes an oval shaped aperture (not shown) located to align with aperture 784. In addition, the angle iron 782 may include apertures (not shown) configured to align with apertures 784 formed within flat plate 780. Portions of angle iron 782 may be connected to the horizontal portion 764 in any suitable manner, such as by welding.

Now that a majority of the subcomponents of spinning device 10 have been described, the general arrangement of the components comprising the device will be set forth in detail with reference generally to FIGS. 1 through 44. Machine structure 700 must first be constructed as described above wherein first structure 710 and second structure 712 are interconnected by connector 714 and the ground support members 716. A sliding mechanism 790 or similar type of suitable apparatus may be mounted to the upper surfaces 721 of the bases 720. The sliding mechanism 790 may be of a type allowing for the lower portion of the mechanism attached to the bases 720 to remain relatively fixed, while the upper portion of the mechanism would be capable of sliding relative to the base 720.

Fasteners (not shown) attach the ears 744 of spindle bracket 730 to the sliding mechanism 790, thereby attaching spindle housing 702 to machine structure 700 and completing the assembly of frame 16. In addition, as should be understood by one of ordinary skill in the art, the attachment of housing 702 to structure 700 via mechanism 790 allows for the relative movement of the spindle housing 702 with respect to the machine structure 700.

A differential 800 may be mounted to the differential bracket 752 in any suitable manner, and a motor 802 may be mounted to the motor bracket 754 in any suitable manner. Motor 802 may be any suitable type of motor, such as an electric or a hydraulic motor, for example. It should be noted that motor 802 is positioned to ensure that the motor 802 is capable of engaging the differential 800.

Spinning arrangement 14 may be attached to the spindle housing 702 in any suitable manner. In the depicted embodiment, for example, the harmonic drive 300 and spinner head 302 may be mated as described previously and attached to the spindle bracket 730 in a suitable fashion. Guard 304 may be positioned over the harmonic drive 300 and spinner head 302 in order to complete the assembly of the spinning arrangement 14.

Vertically orientated slide assemblies, each indicated by numeral 804, may be mounted upon plates 806 that may be affixed to opposing ends of connector 714 just inside the upright member 722 of the structures 710, 712. The plates 806 may be connected to the connector 714 in any suitable manner. For example, in embodiments of the invention, the plates 806 may be welded directly to connector 714, or in embodiments, connector 714 may include recesses (not shown) configured to receive the plates 806.

The vertical plate 22 (FIG. 3) of clamp 12 may then be mounted on the slide assemblies 804, thereby allowing vertical movement of clamp 12 relative to frame 16. In addition, as would be understood by one with skill in the art, the affixing of spinning arrangement 14 to frame 16 as described above may also result clamp 12 being capable of vertical movement relative to spinning arrangement 14.

A threaded rod 808 may be arranged to engage attachment portion 20 (FIG. 3) of clamp 12. The threaded rod 808 may thread into attachment portion 20 and extend through aperture 726 and connector 714. The threaded rod 808 may be retained within the aperture 726 in any suitable manner allowing for the rotation of rod 808, such as by an interconnection with a bearing, for example. In the depicted embodiment, threaded rod 808 includes a pulley 810 mounted at the end of threaded rod 808. Pulley 810 may be sized and configured to receive a drive mechanism, such as a belt (not shown) or chain, for example.

A motor mounting plate 812 may be attached to the top surface of connector 714 in any suitable manner. In the depicted embodiment, motor mounting plate 812 includes an aperture (not shown) sized and configured to receive at least a portion of the shaft of a motor 814. Motor 814 may be any type of suitable motor, such as an electric or a hydraulic motor, for example. A pulley 816 may be mounted upon the shaft of motor 814 at a level sufficient to allow a belt (not shown), or similar mechanism, to connect pulley 816 with pulley 810. Accordingly, rotation of the shaft of motor 814 results in the rotation of pulley 810, thereby causing the rotation of threaded rod 808 due to the interconnection of the pulleys 810, 816 by the belt. As should be understood by one with skill in the art, the rotation of threaded rod 808 results in the vertical movement of clamp 12.

A drive motor 818 may be attached to the frame 16 in any suitable manner. Drive motor 818 may be any type of motor suitable for the depicted application, such as an electric motor or a hydraulic motor, for example. In the depicted embodiment, drive motor 818 may be affixed to a motor mounting plate 820 by fasteners (not shown). Motor mounting plate 820 may be affixed to frame 16 in any suitable manner, such as by fasteners (not shown), for example.

A pulley (not shown) may be attached to the shaft of drive motor 818 in any suitable manner. When properly arranged, a belt (not shown) may connect pulley with grooves 408 in harmonic drive housing 326. It should be noted that pulleys 338, 339 (FIG. 15) of harmonic drive 300 are positioned so that the pulleys 338, 339 may be connected to differential 800 via belts (not shown). In this manner, differential 800 is capable of controlling the relative speed of rotation of the pulleys 338, 339, which in turn determines the speed of rotation of outer spindle 320 and inner spindle 322, as described previously. As should be apparent to one with ordinary skill in the art, differential 800 may be controlled by motor 802 when altering the relative rotational speed of pulleys 338, 339. For example, pulley 822 may be affixed to the motor shaft of motor 802 in a suitable manner. A belt 824 may connect pulley 822 to portion 826 of differential 800. In addition, belts (not shown) may connect portions 828, 830 of differential 800 to the pulleys 338, 339, respectively, thereby allowing differential 800 to control the relative rotational speed of the pulleys 338, 339.

The device 10 may include additional motors (not shown) capable of creating horizontal movement of spindle housing 702 and the attached spinning arrangement 714 relative to clamp 12. Horizontal movement may occur due to the inclusion of horizontal slide mechanisms 790, discussed previously. In addition, it should be noted that clamp 12 may include a mechanism or a means for allowing pivoting of clamp 12 in such a way as to ensure that receiving area 100 may be orientated at various angles with respect to spinning arrangement 714. The inventors anticipate that a similar mechanism may be employed with respect to clamp 112, thereby ensuring that the receiving area 270 therein may be orientated at various angles with respect to the vertical axis of the device 10. As would be understood by one with skill in the art, the orientation of the various receiving areas 100, 270 would create a tilting in any part (not shown) contained within the receiving areas 100, 270.

With reference again to FIG. 3, in operation, a cylindrical workpiece (not shown) may be received by receiving area 100 of clamp 12. To locate the workpiece in receiving area 100, drive assemblies 34 may be activated in order to increase the distance separating the clamping members 30, 32. Once the distance is sufficient to receive a workpiece, the workpiece may be inserted into receiving area 100, and the drive assemblies 34 may then be activated in the reverse direction in order to decrease the distance separating the members 30, 32. Once the members 30, 32 sufficiently contact the piece, the drive assemblies 34 may be deactivated.

It should be noted that clamp 112 may be employed in embodiments of the invention. With reference now to FIGS. 5 through 7 and 14, in clamp 112 the rotation of motor 250 creates rotation of worms 254 by way of chains 252. The rotation of the worms 254 causes rotation of worm gears 174 that, in turn, causes rotation of threaded members 192 and movement of the upper plate 170 and the lower plate 172. The movement and interaction of the plates 170, 172 with respect to the ramp portions 212 (FIG. 11) of clamp assemblies 176 will allow the clamp members 200 to move away from each other, thereby increasing the size of larger receiving area 270. The workpiece may then be inserted into the receiving area 270, and motor 250 may be activated in the opposite direction. The motor 250, in turn, rotates both the worms 254 and worm gears 174 in the direction opposite that described above, and the rotation of the threaded members 192 will force upper plate 170 and lower plate 172 away from one another and into the thicker portions of ramp portions 212. As the upper plate 170 and lower plate 172 progress along the ramp portions 212, the clamp members 200 of the clamp assemblies 176 come together and engage the workpiece positioned within receiving area 270. Once the clamp members 200 sufficiently engage the workpiece, the motor 250 may be deactivated.

Drive motor 818 creates rotation of the roller assemblies 504 by way of the engagement of drive motor 818 with harmonic drive housing 326 (FIG. 15). As the interconnection between the harmonic drive housing 326 and the spinner head 302 has been described previously in detail, it will not be again described here. One with ordinary skill in the art should understand that the previously described connection of housing 326 and head 302 results in the rotation of the rollers 576 around the central longitudinal axis of the spinner head 302.

As should also be understood by one with ordinary skill in the art, the interaction between motor 814 and pulley 810 will create vertical movement of clamp 12 upon activation of motor 814. This vertical movement of clamp 12 allows an operator to lower a workpiece (not shown) retained by clamp 12 toward the rollers 574. Furthermore, the interconnection between the differential 800, the motor 802 and the pulleys 338, 339 (FIG. 15) allows for the relative rotation of inner spindle 322 and outer spindle 320, if desired. As described previously, the relative rotations of inner spindle 322 and outer spindle 320 ultimately results in movement of rollers 576 toward or away from the longitudinal axis of spinner head 302 through the pivoting of the link arm 570 about pivot 574. In this manner, the distance separating rollers 576 may be altered, when desired, thereby allowing the rollers 576 to work the diameter of the workpiece. Furthermore, the distance separating the rollers 576 may be altered while the rollers 576 continue to rotate about the longitudinal axis of the spinner head 302, and thus, as the workpiece retained within clamp 12 is lowered and contacts the rollers 576, the rollers 576 may form a conical shape in the end of the workpiece.

Figure 37:
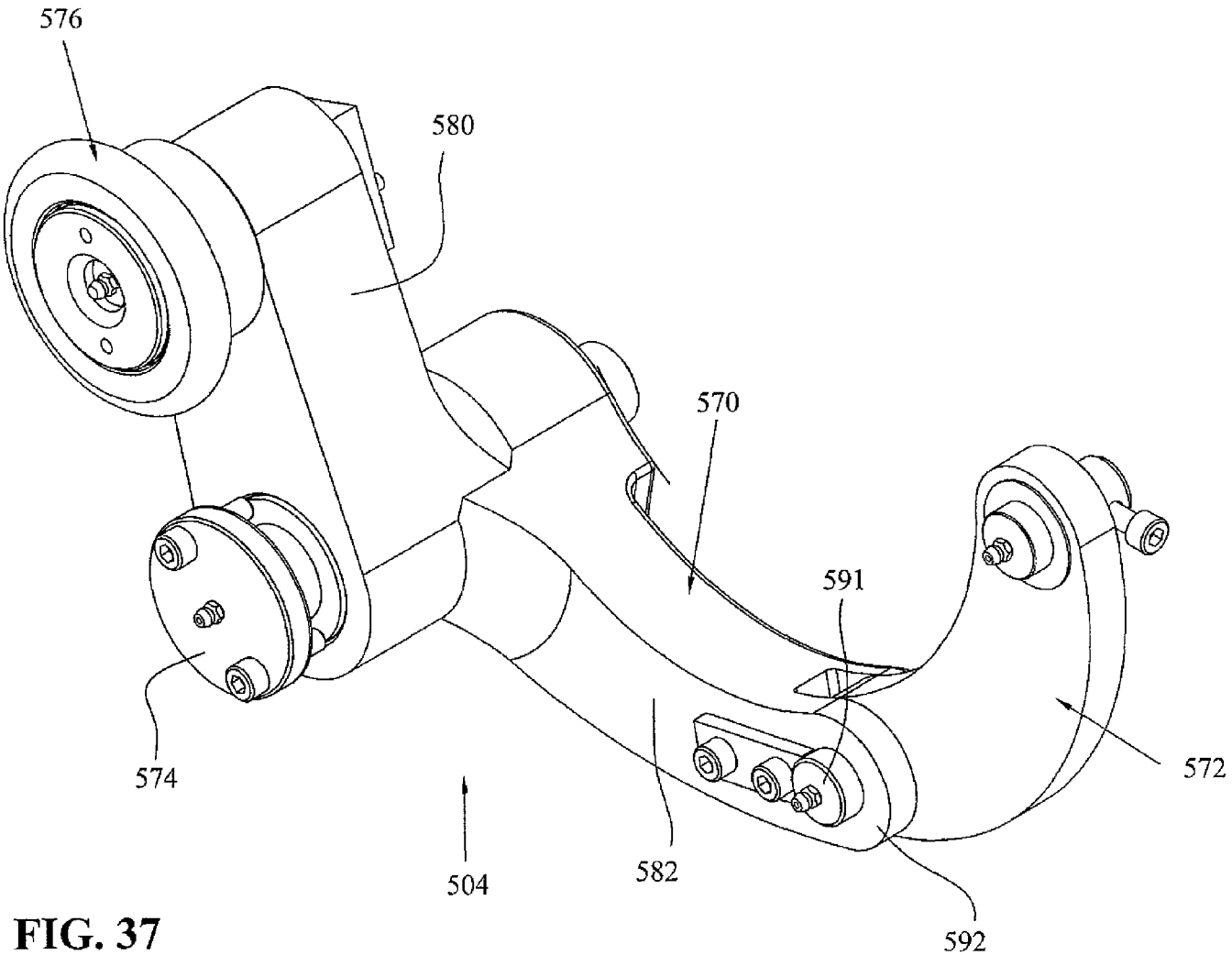
FIG. 37 depicts a perspective view of a component assembly utilized in the spinner head depicted in FIGS. 31A and 31B.
Figure 38:
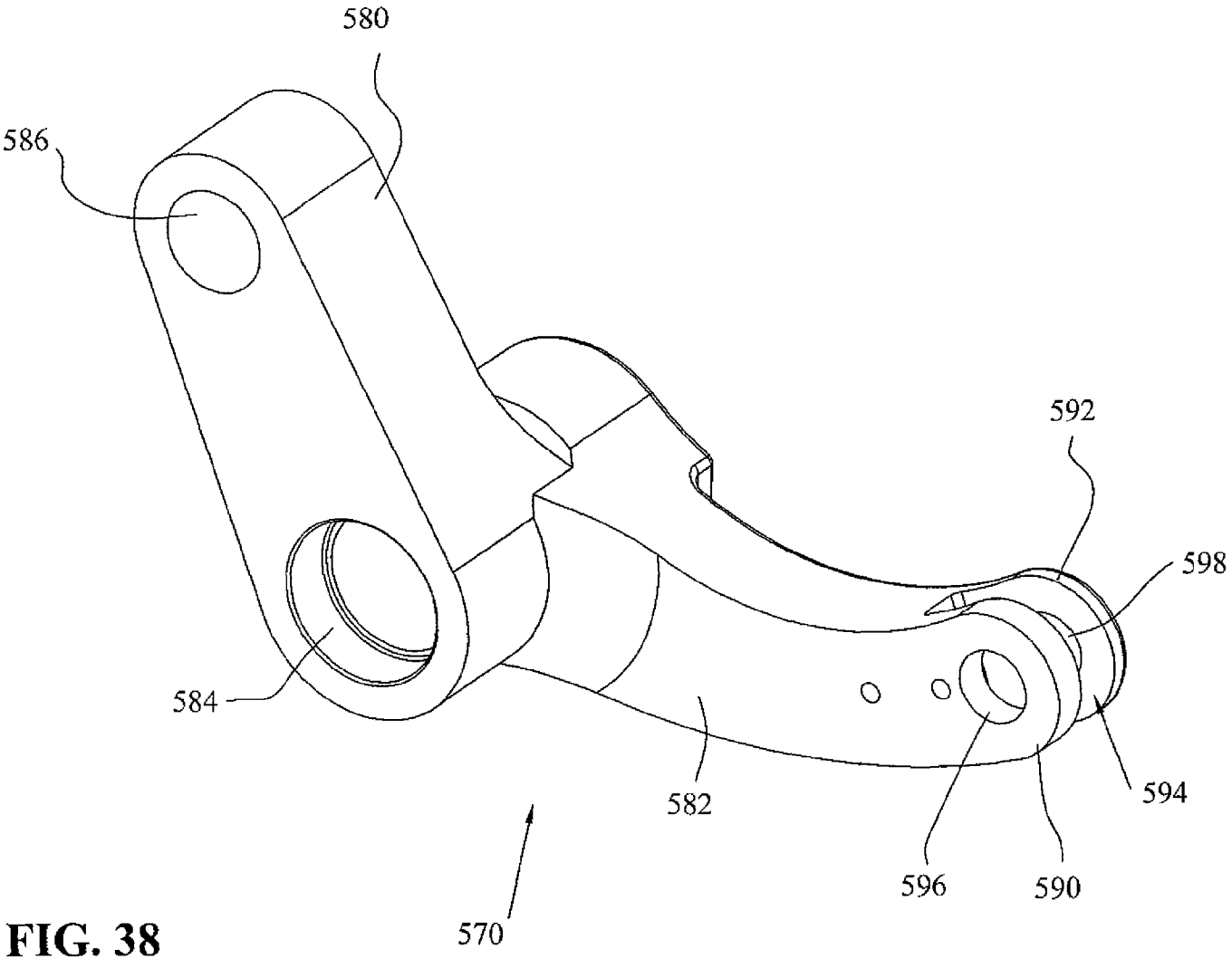
FIG. 38 depicts a perspective view of a component comprising the component assembly depicted in FIG. 37.

The inventors further contemplate that in embodiments of the invention, a second pair of tools (not shown) comprising any suitable tool, such as cutters, for example, may also be included upon the roller assembly 504 (FIG. 37). In embodiments, the cutters may be utilized to cut the piece after the depicted rollers 576 have finished forming the workpiece. The cutters may be located on link arms 570 opposite the rollers 576 so that when the rollers 576 are moved to the outermost position away from the workpiece, the cutters could come into contact with the formed workpiece and cut the workpiece as desired.

As should be understood by one with ordinary skill in the art, activation of the motors (not shown) capable of creating movement in the spindle housing 702 relative to frame 16 and clamp 12, as described above, would allow the rollers 574 to work the part on axes offset from the longitudinal axis of the part. Working of the part in this manner may be achieved through lateral horizontal movement of the spindle housing 702 relative to the clamp 12 in an suitable manner.

As explained previously, clamp 12 may include a pivotable mechanism that allows for the pivoting of receiving area 100, and any workpiece retained therein, relative to the spinner head 302. Accordingly, any workpiece retained by the clamp 12 may be machined at an angle relative to the longitudinal axis of the spinner head 302. The combination of the relative movement and pivoting described above, allows the spinner to act on a piece to by formed in four different axes. As shown specifically in FIG. 1, relative movement between the piece and the spinning wheels may occur along a front to back axis, indicated by "z," along a side to side axis, indicated by "x," along a vertical axis, indicated by "y" and angularly, indicated by "a."

In all instances of the invention, however, the workpiece being machined by the present device is substantially arranged in a vertical orientation. This provides numerous advantages. For example, torque on any kind of clamping mechanism is greatly reduced over that of vertical orientated spinners. In the realm of horizontally orientated spinners, in which a machine part is held horizontally by a clamp, torquing may occur as a portion of the roller force is sometimes directed in the direction of gravity, thereby adding to the force created by the weight of the workpiece. In the present embodiment, the rollers 576 create a force perpendicular to gravity when working the workpiece and, therefore, do not enhance or increase any force created by the weight of the workpiece.

In addition, the vertical arrangement described above provides an advantage over the traditional horizontal arrangement in that the footprint of this vertical arrangement is substantially smaller than that achieved by any horizontal spinner. Specifically, the arrangement of the clamping mechanism above the spinning mechanism along a vertical axis reduces the footprint of the arrangement over than of horizontal spinners in which the clamping arrangement must necessarily be located horizontally offset from the spinning arrangement.

Figure 45:
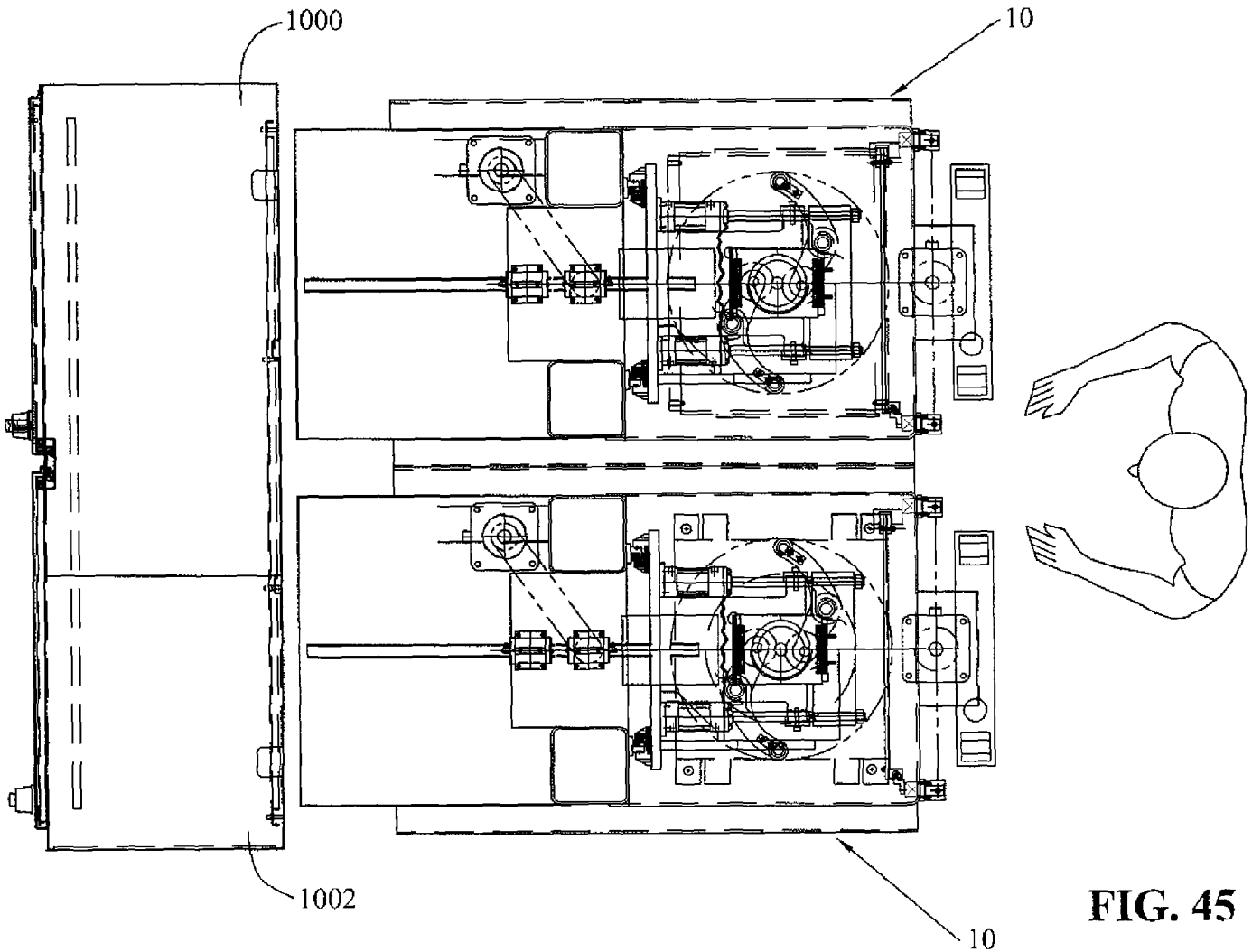
FIG. 45 depicts a top view of two embodiments of the present invention arranged side by side.

As explained above, the vertical spinner arrangement described in the present machine 10 creates a smaller footprint than that achieved in traditional horizontal spinners. This smaller footprint provides numerous advantages, due to the premium on floor space in manufacturing buildings. As shown in FIG. 45, the smaller footprint described above also provides the advantage in which two spinners 10 may be positioned adjacent one another. This type of positioning allows for the control of two spinners 10 by a single CNC dual channel controller housed within electric cabinet 1000. In addition, a single isolation transformer 1002 may also be used to control the two spinners 10. This results in a further reduction in the footprint and floor space utilized by two spinners 10 vis-à-vis the floor space utilized by two traditional horizontal spinner units.

While this invention has been described as having an exemplary design, the present invention may be further modified within the spirit and scope of this disclosure. The application is intended, therefore, to cover any variations, uses, or adaptations of the invention using its general principles. Further, this application is intended to cover such departures from the present disclosure as come within known or customary practice in the art to which this invention pertains.

The invention claimed is:

1. A spinning apparatus comprising:

a clamp including a receiving area adjustable in size and configured to receive at least a portion of a workpiece along a vertical axis;

a spinning arrangement having at least one roller assembly capable of acting on the workpiece along an axis transverse to said vertical axis in order to form at least a portion of the workpiece the spinning arrangement further comprising a spinner head comprising a housing, a hub and at least one roller assembly;

the roller assembly include a link arm, a connector arm, a pivot and a roller, wherein the link arm is configured to rotate about the pivot and the roller is connected to the link arm at one end and the connector is connected to the link arm at an end of the link arm opposite the roller;

a frame configured to support the clamp and the spinning arrangement;

wherein one of the clamp or the spinning arrangement is located vertically above the other of the clamp or the spinning arrangement; and a drive mechanism to drive the spinning arrangement in a rotational sense along the vertical axis about the workpiece.

2. The spinning apparatus as set forth in claim 1 wherein the clamp includes at least two clamping members, each of the clamping members comprising a face directed toward the receiving area and each of the clamping members moveable with respect to the receiving area independently of the remaining clamping members.

3. The spinning apparatus as set forth in claim 2 wherein the clamp includes four clamping members.

4. The spinning apparatus as set forth in claim 1 wherein the spinning arrangement includes a harmonic drive.

5. The spinning apparatus as set forth in claim 1 wherein the connector arm is connected to the hub.

6. The spinning apparatus as set forth in claim 5 wherein the spinning arrangement includes two roller assemblies.

7. The spinning apparatus as set forth in claim 1 wherein at least one of the clamp and the spinning arrangement is moveable with respect to the other of the clamp and the spinning arrangement in a substantially vertical direction.

8. The spinning apparatus as set forth in claim 7 wherein at least one of the clamp and the spinning arrangement is moveable with respect to the other of the clamp and the spinning arrangement in a substantially horizontal direction.

9. The spinning apparatus as set forth in claim 8 wherein a longitudinal axis extends substantially through the center of the spinning arrangement, the clamp is configured to tilt the workpiece with respect to the longitudinal axis.

10. The spinning apparatus as set forth in claim 1 wherein the clamp is arranged vertically above the spinning arrangement.

11. A device for shaping at least an end of a workpiece comprising:

a clamp for holding the workpiece;

a spinning assembly including at least one working member capable of forming at least a portion of the workpiece; and a frame configured to support the clamp and the arrangement above a floor;

wherein the clamp and the spinning assembly may be positioned substantially along an axis extending in a direction substantially perpendicular to the floor, and the spinning assembly has at least one roller assembly capable of acting on the workpiece along an axis transverse to said axis, and wherein at least one of the assembly and the clamp is moveable relative to the other along first and second axes where the second axis is substantially perpendicular to the first axis, and the clamp is capable of pivoting with respect to the spinning assembly.

12. The device for shaping at least a portion of a workpiece as set forth in claim 11 wherein the clamp includes a receiving area for retaining the workpiece, the receiving area being adjustable in size along at least a single axis.

13. The device for shaping at least a portion of a workpiece as set forth in claim 12 wherein the receiving area is adjustable in size along two axes.

14. The device for shaping at least a portion of a workpiece as set forth in claim 11 wherein the spinning assembly includes two working members.

15. The device for shaping at least a portion of a workpiece as set forth in claim 11 wherein the clamp includes a receiving area defined by at least two clamping members, at least one plate partially in contact with one of the clamping members, a motor, a chain, at least one worm, and at least one worm gear including at least one threaded rod, wherein the motor is connected to the at least one worm by way of the chain, the at least one worm engages the at least one worm gear and the threaded rod is interconnected to the at least one plate so that rotation of the threaded rod causes movement of the at least one plate and the movement of the at least one plate causes movement of at least one of the clamping members to alter the size of the receiving area.

16. The device for shaping at least a portion of a workpiece as set forth in claim 15 wherein the clamp includes four clamping members.

17. The device for shaping at least a portion of a workpiece as set forth in claim 15 wherein the clamp members include ramp portions configured to engage the plates.

18. The device for shaping at least a portion of a workpiece as set forth in claim 11 wherein the frame includes a first frame portion and a second frame portion and the first frame portion and the second frame portion each include a base member extending substantially horizontally, an upright member connected to the base extending substantially vertically and a support member extending between the base member and the upright member.

19. The device for shaping at least a portion of a workpiece as set forth in claim 18 further includes a member connecting the upright member of the first frame portion to the upright member of the second frame portion.

20. The device for shaping at least a portion of a workpiece as set forth in claim 19 further including at least one member connecting the base member of the first portion to the base member of the second portion.

21. The spinning apparatus as set forth in claim 4, characterized in that the harmonic drive controls the rotational speed of the spinning arrangement and of the lateral position of the at least one roller assembly.

22. The spinning apparatus as set forth in claim 11 wherein the spinning arrangement includes a harmonic drive.

23. The spinning apparatus as set forth in claim 22, characterized in that the harmonic drive controls the rotational speed of the spinning arrangement and of the lateral position of the at least one roller assembly.

24. A spinning apparatus comprising:

a clamp including a receiving area adjustable in size and configured to receive at least a portion of a workpiece along a vertical axis;

a spinning arrangement having at least one roller assembly capable of acting on the workpiece along an axis transverse to said vertical axis in order to form at least a portion of the workpiece, a longitudinal axis extends substantially through the center of the spinning arrangement, and the clamp is configured to tilt the workpiece with respect to the longitudinal axis;

a frame configured to support the clamp and the spinning arrangement;

wherein one of the clamp or the spinning arrangement is located vertically above the other of the clamp or the spinning arrangement, and at least one of the clamp and the spinning arrangement is moveable with respect to the other of the clamp and the spinning arrangement in a substantially vertical and horizontal direction; and a drive mechanism to drive the spinning arrangement in a rotational sense along the vertical axis about the workpiece.

25. The spinning apparatus as set forth in claim 24 wherein the spinning arrangement includes a harmonic drive.

26. A device for shaping at least an end of a workpiece comprising:

a clamp for holding the workpiece, the clamp includes a receiving area defined by at least two clamping members, at least one plate partially in contact with one of the clamping members, a motor, a chain, at least one worm, and at least one worm gear including at least one threaded rod, wherein the motor is connected to the at least one worm by way of the chain, the at least one worm engages the at least one worm gear and the threaded rod is interconnected to the at least one plate so that rotation of the threaded rod causes movement of the at least one plate and the movement of the at least one plate causes movement of at least one of the clamping members to alter the size of the receiving area;

a spinning assembly including at least one working member capable of forming at least a portion of the workpiece; and a frame configured to support the clamp and the arrangement above a floor;

wherein the clamp and the spinning assembly may be positioned substantially along an axis extending in a direction substantially perpendicular to the floor, and the spinning assembly has at least one roller assembly capable of acting on the workpiece along an axis transverse to said axis.

27. The device for shaping at least a portion of a workpiece as set forth in claim 26 wherein the clamp includes four clamping members.

28. The device for shaping at least a portion of a workpiece as set forth in claim 27 wherein the clamp members include ramp portions configured to engage the plates.

29. The spinning apparatus as set forth in claim 26 wherein the spinning assembly includes a harmonic drive.

30. A device for shaping at least an end of a workpiece comprising:

a clamp for holding the workpiece;

a spinning assembly including at least one working member capable of forming at least a portion of the workpiece; and a frame configured to support the clamp and the arrangement above a floor, the frame comprising:

a first frame portion and a second frame portion and the first frame portion and the second frame portion each include a base member extending substantially horizontally, an upright member connected to the base extending substantially vertically and a support member extending between the base member and the upright member; wherein the clamp and the spinning assembly may be positioned substantially along an axis extending in a direction substantially perpendicular to the floor, and the spinning assembly has at least one roller assembly capable of acting on the workpiece along an axis transverse to said axis.

31. The device for shaping at least an end of a workpiece as set forth in claim 30 further comprising a member connecting the upright member of the first frame portion to the upright member of the second frame portion.

32. The device for shaping at least an end of a workpiece as set forth in claim 31 further comprising at least one member connecting the base member of the first portion to the base member of the second portion.

33. The spinning apparatus as set forth in claim 30 wherein the spinning assembly includes a harmonic drive.

* * * * *